US007564471B2

(12) United States Patent
Uchida

(10) Patent No.: US 7,564,471 B2
(45) Date of Patent: Jul. 21, 2009

(54) LINE HEAD MODULE, EXPOSURE APPARATUS, AND IMAGE FORMING APPARATUS

(75) Inventor: Masahiro Uchida, Chino (JP)

(73) Assignee: Seiko Epson Corporation, Tokyo (JP)

( * ) Notice: Subject to any disclaimer, the term of this patent is extended or adjusted under 35 U.S.C. 154(b) by 392 days.

(21) Appl. No.: 11/348,475

(22) Filed: Feb. 7, 2006

(65) Prior Publication Data

US 2006/0200999 A1 Sep. 14, 2006

(30) Foreign Application Priority Data

Mar. 10, 2005 (JP) ..... 2005-066799
Mar. 10, 2005 (JP) ..... 2005-066800
Mar. 10, 2005 (JP) ..... 2005-066801
Mar. 10, 2005 (JP) ..... 2005-066802

(51) Int. Cl.
*B41J 2/385* (2006.01)

(52) U.S. Cl. ..... 347/130; 347/137; 347/238

(58) Field of Classification Search ..... None
See application file for complete search history.

(56) References Cited

U.S. PATENT DOCUMENTS 4,424,523 A 1/1984 Snelling et al.
4,835,549 A 5/1989 Samejima et al.
5,192,958 A 3/1993 Charnitski
5,341,202 A * 8/1994 Isobe ..... 358/401
5,708,934 A 1/1998 Nagase et al.
5,751,327 A * 5/1998 De Cock et al. ..... 347/130
6,215,511 B1 4/2001 Asako et al.
6,331,915 B1 * 12/2001 Myers ..... 359/599
6,525,752 B2 * 2/2003 Vackier et al. ..... 347/130
6,717,604 B2 4/2004 Nagumo
6,731,322 B2 * 5/2004 Hori ..... 347/238
6,791,660 B1 9/2004 Hayashi et al.
7,317,281 B2 1/2008 Hayashi et al.
2004/0189729 A1 9/2004 Nakahanada et al.
2005/0117014 A1 6/2005 Livne

FOREIGN PATENT DOCUMENTS

CN 1533902 A 10/2004
JP A-60-156082 8/1958
JP A-63-071373 3/1988
JP U-01-091551 6/1989
JP A-02-050854 2/1990
JP U-02-115445 9/1990
JP A-05-088516 4/1991
JP A-03-253362 11/1991
JP A-04-141456 5/1992
JP A-05-221022 8/1993
JP A-07-052427 2/1995

(Continued)

*Primary Examiner*—Stephen D Meier
*Assistant Examiner*—Alexander C Witkowski
(74) *Attorney, Agent, or Firm*—Oliff & Berridge, PLC

(57) ABSTRACT

Provided is a line head module including line heads on which a plurality of light emission elements are arrayed and exposing a photosensitive body by the light from the light emission elements, including: a support having a rotation axis parallel to the photosensitive body; and the plurality of line heads which are provided on the peripheral surfaces of the support and switched with respect to the photosensitive body by rotating the support about the rotation axis.

20 Claims, 21 Drawing Sheets

FOREIGN PATENT DOCUMENTS

| | | |
|---|---|---|
| JP | A-07-175380 | 7/1995 |
| JP | A-08-146856 | 6/1996 |
| JP | A-10-129032 | 5/1998 |
| JP | A-11-254746 | 9/1999 |
| JP | A-2002-292927 | 10/2002 |
| JP | A-2002-326391 | 11/2002 |
| JP | A 2003-001864 | 1/2003 |
| JP | A-2003-039735 | 2/2003 |
| JP | A-2003-243161 | 8/2003 |
| JP | A-2003-316476 | 11/2003 |
| JP | A-2004-058448 | 2/2004 |
| JP | A-2004-163579 | 6/2004 |
| JP | A-2005-519789 | 7/2005 |

* cited by examiner

LINE HEAD MODULE, EXPOSURE APPARATUS, AND IMAGE FORMING APPARATUS

BACKGROUND

1. Technical Field

The present invention relates to a line head module used as an exposure unit in an image forming apparatus, and an exposure apparatus and an image forming apparatus including the line head module.

This application claims the benefit of Japanese Patent Application No. 2005-066799, Japanese Patent Application No. 2005-066800, Japanese Patent Application No. 2005-066801, and Japanese Patent Application No. 2005-066802 filed on Mar. 10, 2005, in the Japan Patent Office, the disclosure of which is incorporated herein in its entirety by reference.

2. Related Art

As an electrophotographic printer, a line printer (image forming apparatus) is known. In this line printer, a charger, a line-shaped printer head (line head), a developing device, a transfer device are arranged in the vicinity of the circumferential surface of a photosensitive drum to be exposed. That is, on the circumferential surface of the photosensitive drum charged by the charger, an electrostatic latent image is formed by performing exposure due to selective light emission of a light emission element provided in the printer head, a toner is fed onto the electrostatic latent image to form a toner image, and the toner image is transferred onto a sheet of paper by the transfer device.

As the light emission element of the printer head, a light emitting diode (LED) is typically used. However, in this case, it is difficult to arrange several thousand light emission points with high precision. Accordingly, recently, an image forming apparatus including, as the printer head, a light emission element array which includes, as the light emission element, an electroluminescence element (EL element), and more particularly, an organic EL element which can arrange light emission points with high precision is suggested (for example, see JP-A-2003-1864).

In a case where the LED or the EL element is used as a light source in the printer head, since one head is assigned to a photosensitive drum for each color, the life span of the light source must increase in order to increase the printable number of the printer. In addition, in order to obtain a high printing speed, the light amount of the light source must increase. However, if the light amount increases, the life span of the organic EL element decreases and thus the printable number decreases.

Moreover, since the definition of the printer head is uniform, over-specification may be generated when a line image is output.

SUMMARY

An advantage of some aspects of the invention is that it provides a line head module which has long life span and can perform high-speed printing, and an exposure apparatus and an image forming apparatus including the line head module.

In addition, since the EL element is deteriorated when the EL element contacts moisture or oxygen in air, the EL element must be sealed such that the EL element does not come into contact with air when the EL element is formed. A method of sealing the EL element includes "solid sealing" for bonding glass substrates with each other using an adhesive and "can sealing" for providing a drying agent to a glass or metal member having a digging configuration and sealing and covering the EL element. Particularly, the member having the digging configuration, which is used in the can sealing, has high manufacturing cost. In addition, when the member having the digging configuration is used as the light source of the printer head, since it has an elongate configuration, it is difficult to ensure a strength. Furthermore, if the member having the digging configuration is made of metal, it is difficult to ensure precision.

An advantage of some aspects of the invention is that it provides a line head module having long life span, a sufficient printing speed, and a sealing configuration which can reduce member cost or manufacturing cost and ensure a sufficient strength, and an exposure apparatus and an image forming apparatus including the line head module.

In a case of an output apparatus such as a toner-fixing type printer or copier, since a unit for thermally fixing a toner is provided in the apparatus, the interior of the apparatus has a high temperature of 50° C. or more. Furthermore, in order to perform high-speed printing, the light source of the printer head requires a great amount of the light. Meanwhile, in order to generate the great amount of the light, a large electrical load is applied to a light emission element and thus the light emission element itself generates heat. This heat may deteriorate the light emission element.

An advantage of some aspects of the invention is that it provides a line head module which prevents a light emission element from being deteriorated due to heat and improves durability, and an exposure apparatus and an image forming apparatus including the line head module.

According to an aspect of the invention, there is provided a line head module including line heads on which a plurality of light emission elements are arrayed and exposing a photosensitive body by the light from the light emission elements, including: a support having a rotation axis parallel to the photosensitive body; and the plurality of line heads which are provided on the peripheral surfaces of the support and switched with respect to the photosensitive body by rotating the support about the rotation axis. The support may be formed in a column shape (polygonal column shape) or a plate shape.

By this configuration, since the plurality of line heads are assigned to one photosensitive body, it is possible to increase the life span of the line head as the module and perform printing with a high speed and a great amount of the light. Moreover, since the line heads are switched by rotating the support, the size of the line head module is reduced and thus the exposure apparatus and the image forming apparatus including the exposure apparatus as the exposure unit can be minimized.

In the invention, the plurality of line heads may be switched depending on the reduction in the light amount of the light emission elements.

By this configuration, it is possible to maintain uniform printing quality for a long time. The reduction in the light amount may be directly detected using a sensor or determined based on a print condition (the light amount, a print speed, or the like) or the print number. It is preferable that the line heads are automatically switched depending on the reduction in the light amount.

In the invention, an optical imaging system which images the light from the light emission elements may be provided in each of the plurality of line heads.

By this configuration, it is possible to satisfactorily image the light emitted from the light emission element on the photosensitive body.

In the invention, the light emission elements may be electroluminescence elements (EL elements). The EL element has brightness (light amount) lower than that of a LED. However, in the invention, since a high brightness state can be maintained for a long time by switching the plurality of line heads, the EL element has sufficiently high practicality. Moreover, as the EL element, an organic EL element which can arrange light emission points with high precision may be suitably used.

According to a further aspect of the invention, there is provided an exposure apparatus including the line head module according to the invention; and the photosensitive body which is exposed by the light from the light emission elements included in the line head module. In addition, according to a still further aspect of the invention, there is provided an image forming apparatus including the exposure apparatus as an exposure unit.

By this configuration, it is possible to provide an image forming apparatus which can print plural sheets with a high speed.

According to a further aspect of the invention, there is provided a line head module including line heads on which a plurality of light emission elements are arrayed and exposing a photosensitive body by the light from the light emission elements, including: a support having a rotation axis parallel to the photosensitive body; and the plurality of line heads which are provided on the peripheral surfaces of the support and switched with respect to the photosensitive body by rotating the support about the rotation axis, wherein the plurality of line heads include plural types of line heads having different specifications and are switched depending on a use thereof. The support may be formed in a column shape (polygonal column shape) or a plate shape.

By this configuration, since the plurality of line heads are assigned to one photosensitive body, it is possible to increase the life span of the line head as the module and perform printing with a high speed and a great amount of the light. Moreover, since the line heads are switched by rotating the support, the size of the line head module is reduced and thus the exposure apparatus and the image forming apparatus including the exposure apparatus as the exposure unit can be minimized. In addition, since the plurality of line heads having different specifications are provided on the same support, it is possible to obtain the output corresponding to a user's request by switching the line heads depending on the use thereof. Furthermore, by switching the line heads, the respective line heads can be efficiently utilized and an output apparatus such as a printer has a high specification.

In the invention, the line heads having the same specification which is frequently used may be provided in plural and the line heads may be switched depending on the reduction in the light amount of the light emission elements.

By this configuration, it is possible to obtain stable printing quality for a long time even when printing is performed with the specification which is frequently used to rapidly reduce the light amount of the light emission elements. The reduction in the light amount may be directly detected using a sensor or determined based on a print condition (the light amount, a print speed, or the like) or the print number. It is preferable that the line heads are automatically switched depending on the reduction in the light amount.

In the invention, an optical imaging system which images the light from the light emission elements may be provided in each of the plurality of line heads.

By this configuration, it is possible to satisfactorily image the light emitted from the light emission element on the photosensitive body.

In the invention, the light emission elements may be electroluminescence elements (EL elements). The EL element has brightness (light amount) lower than that of a LED. However, in the invention, since a high brightness state can be maintained for a long time by switching the plurality of line heads, the EL element has sufficiently high practicality. Moreover, as the EL element, an organic EL element which can arrange light emission points with high precision may be suitably used.

According to a still further aspect of the invention, there is provided an exposure apparatus including the line head module according to the invention; and the photosensitive body which is exposed by the light from the light emission elements included in the line head module. In addition, according to a still further aspect of the invention, there is provided an image forming apparatus including the exposure apparatus as an exposure unit.

By this configuration, it is possible to provide an image forming apparatus which can print plural sheets with a high speed.

According to a still further aspect of the invention, there is provided a line head module including line heads on which a plurality of electroluminescence (EL) elements are arrayed and exposing a photosensitive body by the light from the EL elements, including: a support having a rotation axis parallel to the photosensitive body; and the plurality of line heads which are provided on the peripheral surfaces of the support and switched with respect to the photosensitive body by rotating the support about the rotation axis, wherein the surfaces of the line heads, on which the EL elements are formed, are supported by the support, and the EL elements are sealed by the support. The support may be formed in a column shape (polygonal column shape) or a plate shape.

By this configuration, since the plurality of line heads are assigned to one photosensitive body, it is possible to increase the life span of the line head as the module and perform printing with a high speed and a great amount of the light. Moreover, since the line heads are switched by rotating the support, the size of the line head module is reduced and thus the exposure apparatus and the image forming apparatus including the exposure apparatus as the exposure unit can be minimized. In addition, since the support functions a sealing member for sealing the EL elements of the line heads, it is possible to more reduce member cost, compared with a case of providing respective sealing members to the line heads. Furthermore, since the support of the invention must have a predetermined strength in order to mount the plurality of line heads, a sealing strength is higher than that of a case of using a thin sealing substrate.

In the invention, concave portions may be provided in the side surfaces of the support and the EL elements may be hermetically sealed (can-sealed) in the concave portions sealed between the support and the line heads.

Such a can sealing configuration generally applies to an EL apparatus used in a display. Since such an EL apparatus must be thin, a can sealing substrate (glass substrate) must be also thin. Generally, it is difficult to form a digging configuration in a thin substrate, and the manufacturing cost increases. Meanwhile, since the line head used as the exposure unit has no such a limitation, a thick member can be used in the support. In addition, since the plurality of line heads are mounted, the support is thick to some extents in order to ensure the strength thereof. Since the thick support has a larger strength and more easily manufactured, compared with the can sealing substrate having a small thickness, the manufacturing cost can decrease. In addition, in the line head module according to the present embodiment, since the light from the light head is emerged from the opposite side of the support, the support may not be transparent. Accordingly, cheaper metal member can be used as the support and thus the manufacturing cost can decrease.

The line head module may further include an adhesive layer which adheres the line heads to the support, and the EL elements may be covered by the adhesive layer and the support. In this case, since the digging configuration need not be formed, the manufacturing cost can more decrease.

An optical imaging system which images the light from the light emission elements may be provided in each of the plurality of line heads. In this case, it is possible to satisfactorily image the light emitted from the light emission element on the photosensitive body.

According to a still further aspect of the invention, there is provided an exposure apparatus including the line head module according to the invention; and the photosensitive body which is exposed by the light from the EL elements included in the line head module. In addition, according to a still further aspect of the invention, there is provided an image forming apparatus including the exposure apparatus as an exposure unit.

By this configuration, it is possible to provide an image forming apparatus which can print plural sheets with a high speed.

According to a still further aspect of the invention, there is provided a line head module including line heads on which a plurality of light emission elements are arrayed and exposing a photosensitive body by the light from the light emission elements, including: a support which supports the line heads; a flow channel which is provided in the support and thermally connected to the line heads through the support; and a cooling medium which circulates through the flow channel to cool the support. The support is made of metal having high heat transmission, such as SUS, aluminum, brass, or the like.

By this configuration, it is possible to efficiently cool the line head by the cooling medium which circulates through the support. Accordingly, it is possible to improve the durability of the light emission element and to realize an image forming apparatus which can print plural sheets.

The circulation of the cooling medium may be controlled depending on the state of driving the line heads. For example, the circulation of the cooling medium is turned on/off in synchronization with the driving/stop of the line head or the circulation speed may be controlled depending on the overheat state of the line head (the temperature, the light emission time, and the light emission brightness of the light emission element, and the temperature of the inside of the exposure apparatus).

By this configuration, the output of the line head becomes stable and thus good printing quality can be obtained.

The support may have a rotation axis parallel to the photosensitive body, and the line heads may be provided in plural on the peripheral surfaces of the support and switched with respect to the photosensitive body by rotating the support about the rotation axis.

By this configuration, since the plurality of line heads are assigned to one photosensitive body, it is possible to increase the life span of the line head as the module and perform printing with a high speed and a great amount of the light. Moreover, since the line heads are switched by rotating the support, the size of the line head module is reduced and thus the exposure apparatus and the image forming apparatus including the exposure apparatus as the exposure unit can be minimized.

The line head module may further include a tube which allows the cooling medium to circulate into or out of the flow channel. As the material of the tube, resin having high flexibility and a relatively high strength such as Teflon (registered trademark) may be used.

By this configuration, since the tube is deformed depending on the rotation of the support, the cooling medium is not prevented from circulating.

An optical imaging system which images the light from the light emission elements may be provided in each of the plurality of line heads.

By this configuration, it is possible to satisfactorily image the light emitted from the light emission element on the photosensitive body.

In the invention, the light emission elements may be electroluminescence elements (EL element). The EL element has brightness (light amount) lower than that of a LED. However, in the invention, since a high brightness state can be maintained for a long time by switching the plurality of line heads, the EL element has sufficiently high practicality. Moreover, as the EL element, an organic EL element which can arrange light emission points with high precision may be suitably used.

According to a still further aspect of the invention, there is provided an exposure apparatus including the line head module according to the invention; and the photosensitive body which is exposed by the light from the light emission elements included in the line head module. In addition, according to a still further aspect of the invention, there is provided an image forming apparatus including the exposure apparatus as an exposure unit.

By this configuration, it is possible to provide an image forming apparatus which can print plural sheets with a high speed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
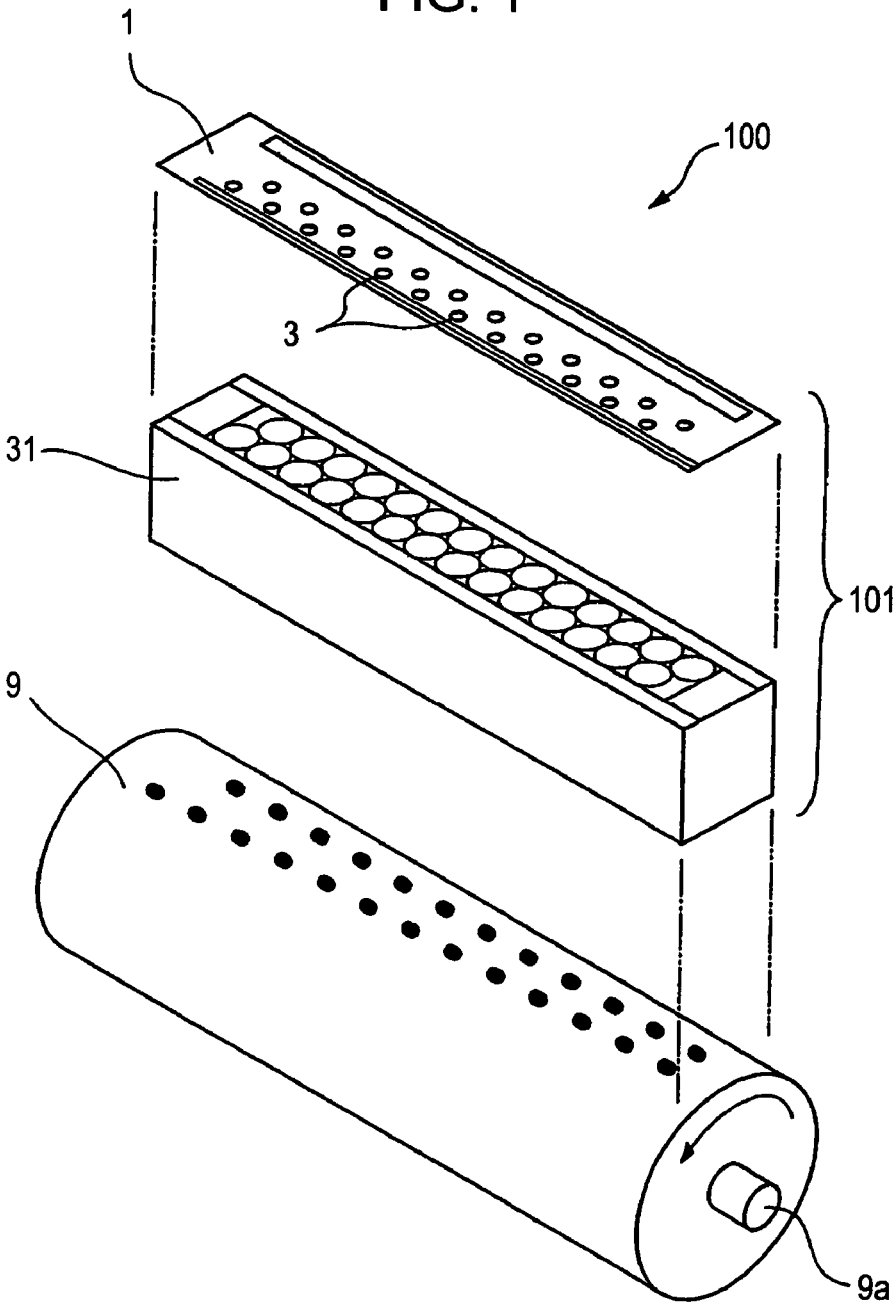
FIG. 1 schematically illustrates a configuration of an exposure apparatus according to a first embodiment of the invention.

Hereinafter, embodiments of the invention will be described with reference to the attached drawings. In the drawings, the dimensions of elements are adequately changed in order to easily view the drawings.

Exposure Apparatus

First, an exposure apparatus of the invention will be described.

FIG. 1 illustrates an exposure apparatus according to a first embodiment of the invention. In FIG. 1, reference numeral 100 denotes the exposure apparatus. The exposure apparatus 100 is used as an exposure unit in an image forming apparatus and includes a line head 1, a lens array (optical imaging system) 31 for imaging the light from the line head 1, and a photosensitive drum (photosensitive body) 9 which is exposed by the light from the line head 1 through the lens array 31.

Line Head Module

Figure 2A:
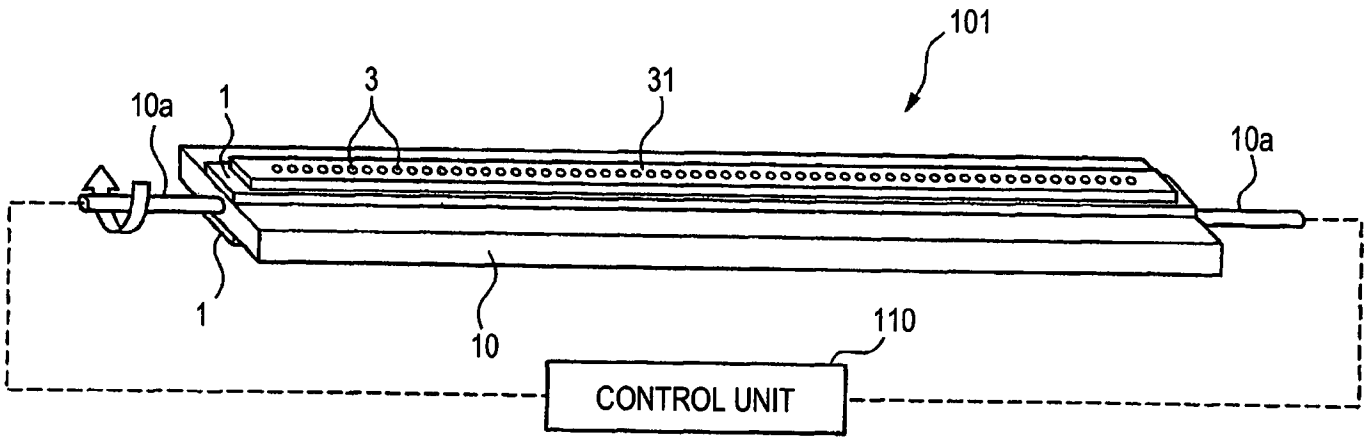
FIG. 2A is a perspective view of a line head module.
Figure 2B:
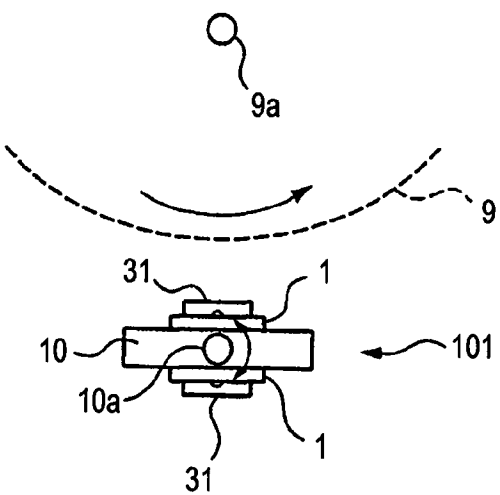
FIG. 2B is a cross-sectional view thereof.

FIGS. 2A and 2B schematically illustrate a configuration of a line head module 101, where FIG. 2A is a perspective view thereof and FIG. 2B is a cross-sectional view thereof.

As illustrated in FIGS. 2A and 2B, the line head module 101 includes line heads 1 in which a plurality of light emission elements 3 are arrayed, lens arrays 31 in which lens elements for imaging the light from the line head 1 are arrayed, and a support 10 for supporting the line head 1.

In FIGS. 2A and 2B, the support 10 is formed in a plate shape, and a rotation axis 10*a*, which extends in a direction parallel to the main surface of the support 10, is provided at the center of the support 10. The rotation axis 10*a* is connected to a control unit 110 and the rotation of the support 10 is controlled by a control signal from the control unit 110. The line heads 1 are provided on a plurality of peripheral surfaces which are arranged in the peripheral direction of the support 10, that is, the front and rear surfaces of the support 10. The two line heads 1 are switched by rotating the support 10 about the rotation axis 10*a*. In addition, the driving of the line heads 1 is switched by switching the line heads 1. That is, while one line head 1 is selected, the other line head 1 is not driven.

The line heads 1 are switched depending on, for example, the reduction in the amount of the light emitted from the light emission elements 3 included in the line head 1. In a case where the light amount of the light emission elements 3 is insufficient when the photosensitive drum 9 is exposed, the support 10 rotates about the rotation axis 10*a* by 180° such that the other line head 1 can be used. The reduction in the light amount may be directly detected using a sensor or determined based on a print condition (the light amount, a print speed, or the like) or the print number. It is preferable that the line heads 1 are automatically switched depending on the reduction in the light amount. For example, in a case where one line head 1 can print two hundred thousand sheets at a speed of 20 ppm, the control unit 110 may be programmed such that, when the print number becomes two hundred thousands, the support 10 automatically rotates about the rotation axis 10*a* by 180° and thus the other line head 1 can be used. By this configuration, the image forming apparatus can print four hundred thousand sheets.

Figure 3A:
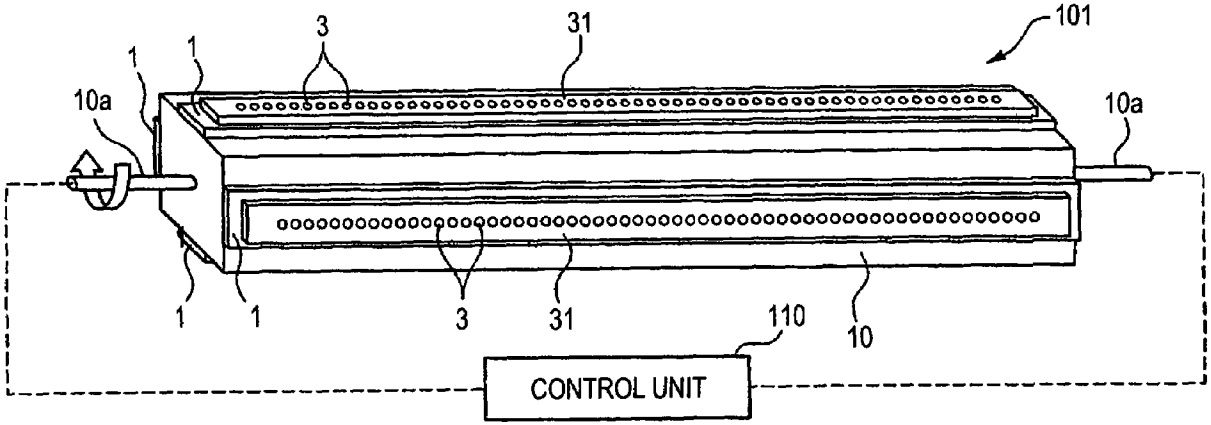
FIG. 3A is a perspective view illustrating another configuration of the line head module.
Figure 3B:
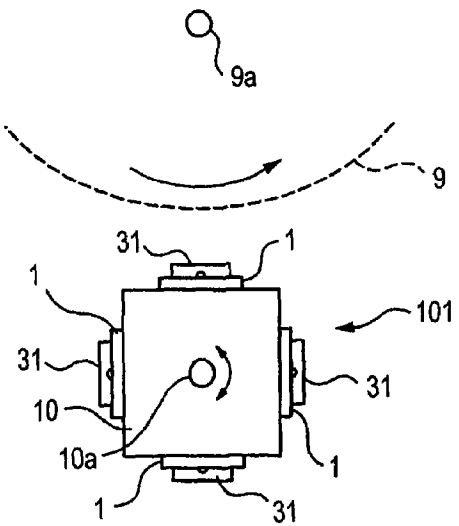
FIG. 3B is a cross-sectional view thereof.

In the line head module 101 of FIGS. 3A and 3B, the support 10 is formed in a square column shape. A rotation axis 10*a* parallel to a rotation axis 9*a* of the photosensitive drum 9 is provided at the center of the support 10. The rotation axis 10*a* is connected to the control unit 110 and the rotation of the support 10 is controlled by a control signal from the control unit 110. The line heads 1 are provided on a plurality of peripheral surfaces which are arranged in the peripheral direction of the support 10, that is, the four side surfaces of the support 10. The line heads 1 are switched by rotating the support 10 about the rotation axis 10*a*. The line heads 1 are switched by rotating the support 10 about the rotation axis 10*a* by 90°. In addition, the driving of the plurality of line heads 1 is switched by switching the line heads 1. That is, while any one line head 1 is selected, the other line heads 1 are not driven. In the line head module 101, if the printable number is calculated using the same condition as the above-referenced condition, the printable number is eight hundred thousands.

In addition, in FIGS. 3A and 3B, although the line heads 1 are provided on all the side surfaces of the support 10, the line heads 1 need not be necessarily provided on all the side surfaces. That is, the line heads 1 may be provided on only two or three side surfaces. Furthermore, as the support 10, a polygonal column such as a triangular column, a pentagonal column, or a hexagonal column may be used. The line heads 1 may be provided on at least two side surfaces of the polygonal column. Moreover, as the support 10, a column having curved surfaces at a portion thereof, such as a circular column or an elliptical column, may be used. In order to standardize the lens arrays 31, it is preferable that the cross-sectional shape of the column such as the circular column or the polygonal column is a regular polygonal or circular. In addition, in FIGS. 3A and 3B, although the support 10 is a solid column, the support 10 may be a hollow column.

Furthermore, in the present embodiment, the plurality of line heads 1 provided on the same support 10 can be mutually used as spares. Accordingly, it is preferable that the line heads 1 have the same specification. Alternatively, the line heads 1 may have different specifications such that the line heads 1 can complement one another.

In the present embodiment, Selfoc Lense Array (SLA: Japanese trademark Registration No. 1634249), which is a same-magnification erect imaging system, is used as the lens array 31. The lens arrays 31 are provided to the respective line heads 1 provided on the side surfaces of the support 10. The lens arrays 31 are integrally held on the line heads 1 in the state that they are aligned with the line heads 1. By this configuration, the line head module 101 images the light emitted from any one line head 1 on the surface of the photosensitive drum 9, which is an imaging surface, in an erect state with the same magnification.

Line Head

Figure 4:
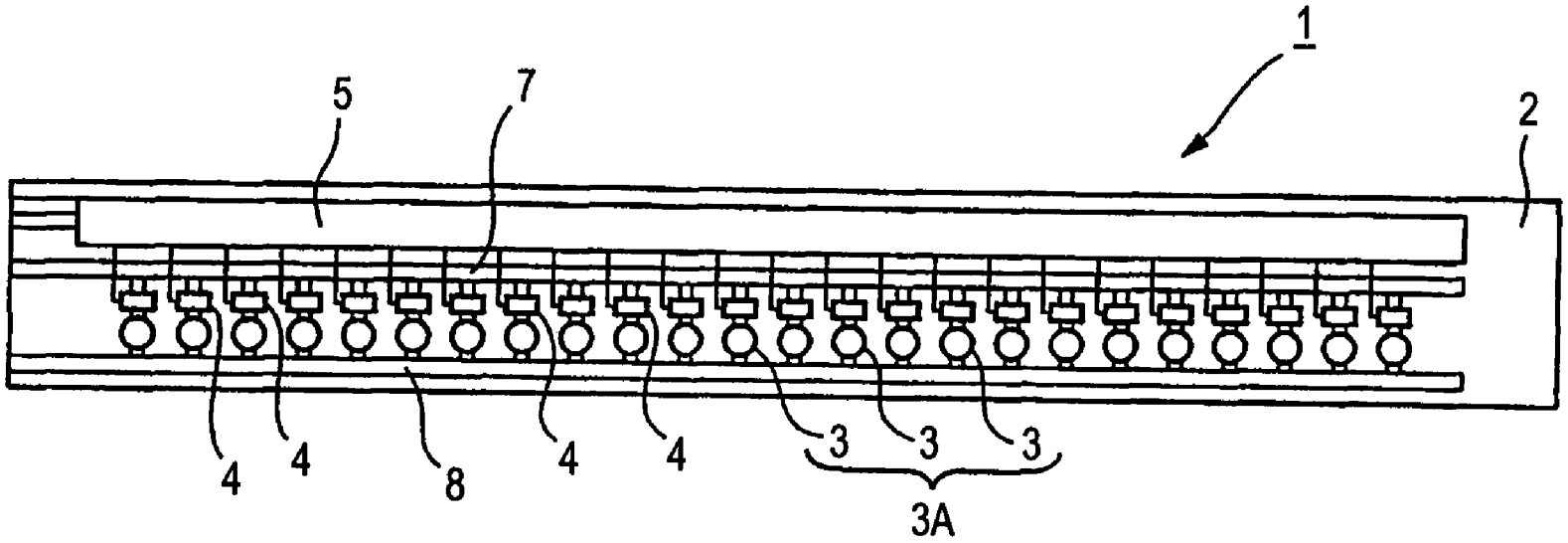
FIG. 4 is a view of illustrating a line head.

FIG. 4 illustrates a line head 1. The line head 1 is configured by integrally providing a light emission element row (light emission line) 3A in which a plurality of light emission elements 3 are arrayed on an elongate rectangular element substrate 2, a driving element group having driving elements 4 for driving the light emission elements 3, and a control circuit group 5 for controlling the driving of the driving elements 4 (driving element group). Although the organic EL element is used as the light emission element 3, an inorganic EL element or a light emitting diode LED may be used. As illustrated in FIG. 1, the light emerging surface of the line head 1 faces the photosensitive drum 9. At this time, the row direction of the light emission element row 3A (alignment direction of the light emission element) is parallel to the rotation axis 9*a* of the photosensitive drum 9.

Moreover, in FIG. 4, although the light emission element row 3A is formed of a row of organic EL elements 3, two rows of organic EL elements 3 may be arranged in a zigzag shape. In this case, the pitch between the organic EL elements 3 can be reduced in a longitudinal direction of the line head 1 and thus it is possible to improve the resolution of the image forming apparatus.

The organic EL element 3 includes at least an organic light emission layer between a pair of electrodes and emits the light by applying current to the light emission layer from the pair of electrodes. One electrode of the organic EL element 3 is connected with a power supply line 8 and the other electrode thereof is connected with a power supply line 7 through the driving element 4. The driving element 4 is composed of a switching device such as a thin film transistor (TFT) or a thin film diode (TFD). If the TFT is used as the driving element 4, the source region of the TFT is connected with the power supply line 7 and the gate electrode thereof is connected with the control circuit group 5. In addition, the operation of the driving element 4 is controlled by the control circuit group 5 and energization of the organic EL element 3 is controlled by the driving element 4.

Moreover, the detailed configurations of the organic EL element 3 and the driving element 4 will be described later.

SLA

Figure 5:
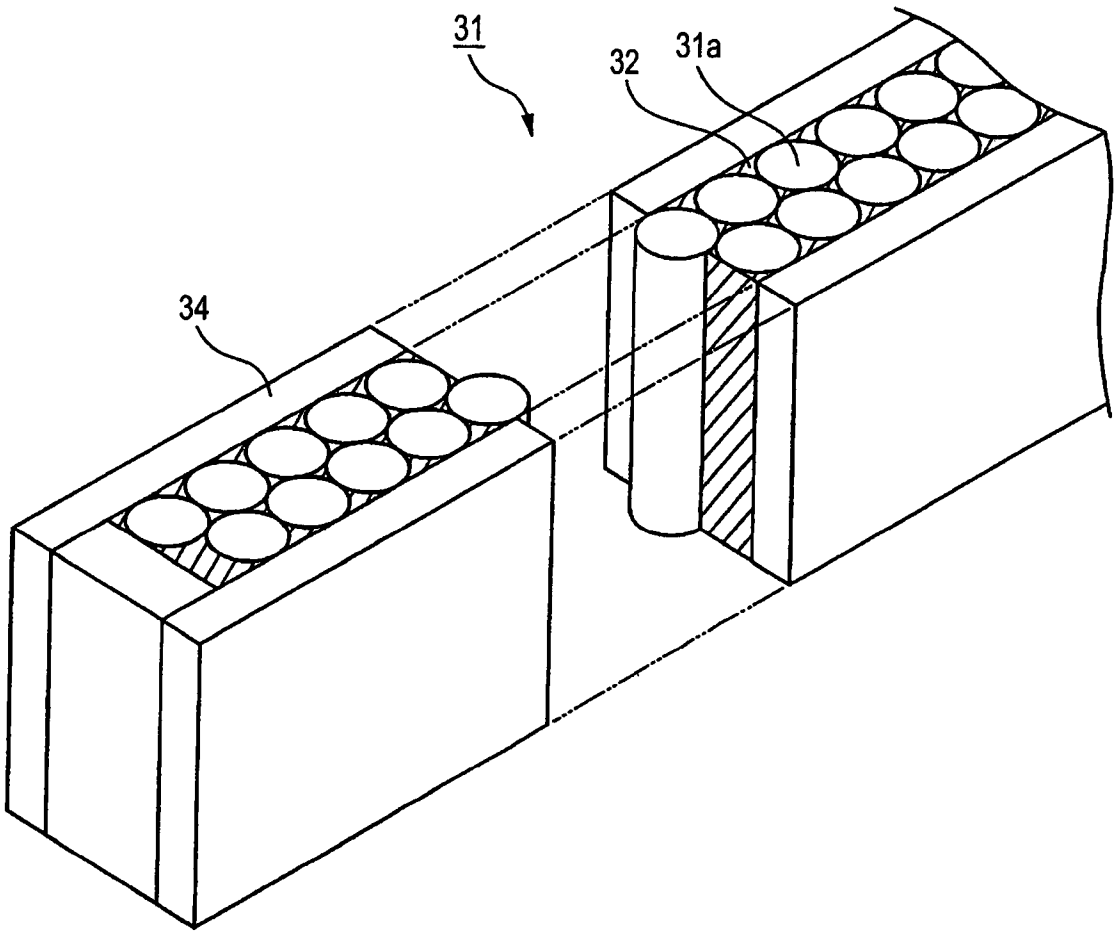
FIG. 5 is a perspective view of a SL array.

FIG. 5 is a perspective view of a SL array as the lens array 31. In the lens array (SLA) 31, two rows of SL elements 31*a* are arranged in a zigzag shape. Furthermore, black silicon resin 32 is filled in the gap between the SL elements 31*a* which are arranged in the zigzag shape and frames 34 are provided at the peripheries thereof.

The SL element 31*a* is a rod-shaped lens having a refractive index distribution from the center of its axis to the circumference. Accordingly, the light incident to the SL element 31*a* travels meanderingly therein with a regular period. Thus, if the length of the SL element 31*a* is adjusted, the image can be formed in an erect state with the same magnification. Furthermore, since the SL element 31*a*, which forms the image in the erect state with the same magnification, can superpose the images formed by adjacent SL elements 31*a* with each other, a broad image can be obtained. Accordingly, the SLA 31 illustrated in FIG. 5 images the light from the line head 1 with high precision.

Organic EL Element and Driving Element

Next, the detailed configurations of the organic EL element or the driving element in the line head will be described with reference to FIGS. 6A and 6B.

In a case of bottom emission type that the light emitted from a light emission layer 60 is emerged from a pixel electrode 23, since the emitted light is emerged from the element substrate 2, the element substrate 2 is transparent or semi-transparent. For example, the element substrate 2 is made of glass, quartz, resin (plastic or plastic film). Particularly, the glass substrate is adequately used.

Moreover, in a case of a top emission type that the light emitted from the light emission layer 60 is emerged from a cathode (opposite electrode) 50, since the emitted light is emerged from a sealing substrate facing the element substrate 2, the element substrate 2 may be transparent or opaque. The opaque substrate is formed of, for example, ceramic such as alumina or a metal sheet such as stainless steel which is subjected to an insulating treatment such as surface oxidation. Alternatively, the opaque substrate may be formed of thermosetting resin or thermoplastic resin.

In the present embodiment, the bottom emission type is employed and thus the element substrate 2 is made of transparent glass.

On the element substrate 2, a circuit unit 11 including a driving TFT 123 (driving element 4) connected to the pixel electrode 23 is formed and the organic EL elements 3 is formed thereon. Each of the organic EL elements 3 includes the pixel electrode 23 which functions an anode, a hole transport layer 70 for injecting/transporting holes from the pixel electrode 23, the light emission layer 60 made of a organic EL material, and a cathode 50, which are formed in this order.

Figure 6A:
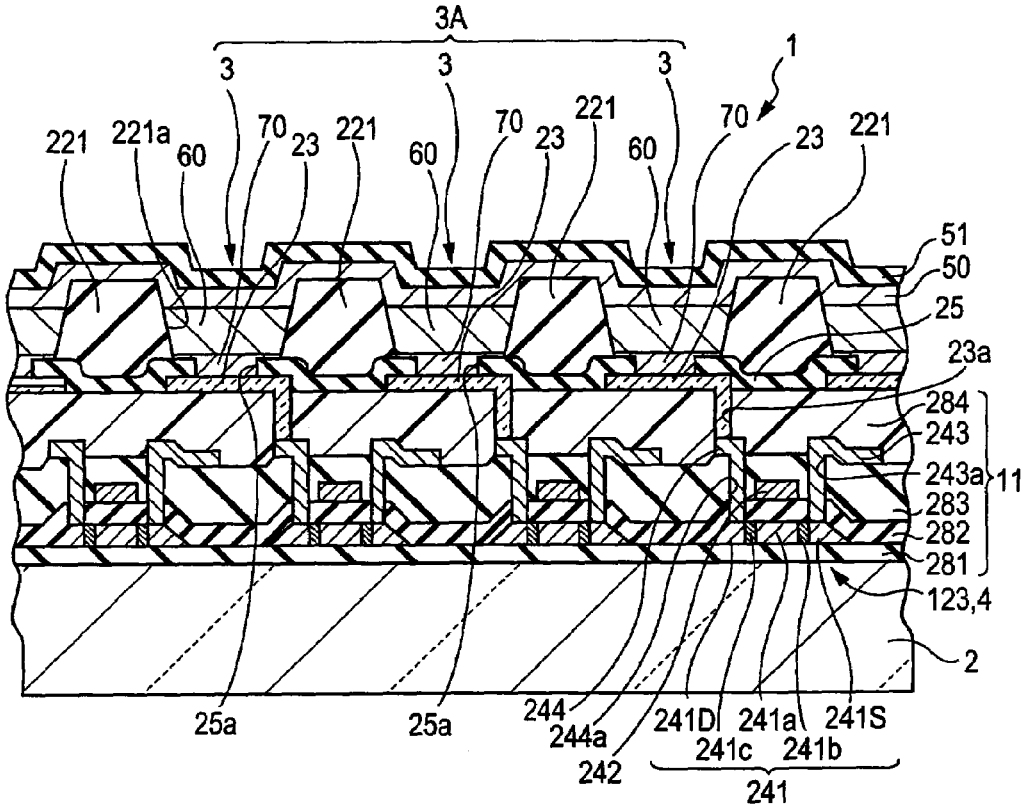
FIG. 6A is a cross-sectional view illustrating main portions of the line head and FIG. 6B is a view illustrating the line head.
Figure 6B:
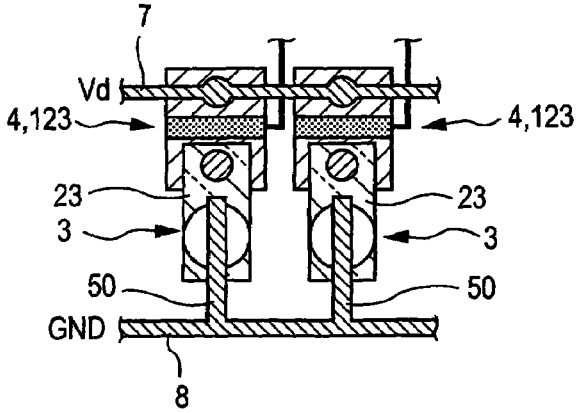

Here, FIG. 6B illustrates the organic EL element 3 and the driving TFT 123 (driving element 4) in correspondence with FIG. 4. In FIG. 6B, the power supply line 7 is connected to source/drain electrode of the driving element 4 and the power supply line 8 is connected to the cathode 50 of the organic EL element 3.

Furthermore, by the above-referenced configuration, as illustrated in FIG. 6A, the organic EL element 3 emits the light by coupling holes injected from the hole transport layer 70 with electrons injected from the cathode 50 in the light emission layer 60.

In the present embodiment of the bottom emission type, the pixel electrode 23, which functions as the anode, is formed of a transparent conductive material, and preferably, Indium-Tin-Oxide (ITO).

The material of the hole transport layer 70 is dispersion liquid of poly-3,4-ethylenedioxythiophene and polystyrene sulfonic acid (PEDOT/PSS), that is, dispersion liquid formed by dispersing poly-3,4-ethylenedioxythiophene in polystyrene sulfonic acid which is a dispersion medium and then dispersing it in water.

Moreover, the material of the hole transport layer 70 is not limited to this, and may include various materials. For example, the hole transport layer 70 may be made of a material formed by dispersing polystyrene, Polypyrrole, polyaniline, polyacethylene or a derivative thereof in adequate dispersion liquid such as polystyrene sulfonic acid.

A material for forming the light emission layer 60, a general light emission material which emits phosphorescence or fluorescence is used. In addition, in the present embodiment, although the light emission layer having a light emission wavelength band corresponding to red is employed, the light emission layer having the light emission wavelength band corresponding to green or blue may be employed. In this case, the used photosensitive body has sensitivity in the light emission region.

The material of the light emission layer 60 is (poly)fluorene derivative (PF), polyparaphenylenevinylene derivative (PPV), polyphenylene derivative (PP), polyparaphenylene derivative (PPP), polyvinyl carbazole (PVK), polythiophene derivative, or polysilane such as polymethylphenyl silane (PMPS). In addition, a material formed by doping a high molecular material such as perylene pigment, coumarin pigment, rhodamine pigment or a low molecular material such as Rubrene, perylene, 9,10-diphenylanthracene, tetrabutadiene, nile red, coumarin 6, quinacridone into the above-referenced high molecular material may be used.

The cathode 50 covers the light emission layer 60 and is formed, for example, by forming Ca at a thickness of 20 nm and forming Al at a thickness 200 nm thereon. Thus, the cathode 50 has a laminated configuration and Al functions as a reflective layer.

Moreover, a sealing substrate (not illustrated) is bonded on the cathode 50 through an adhesive layer.

In addition, as described above, the circuit unit 11 is provided below the organic EL elements 3. The circuit unit 11 is formed on the element substrate 2. That is, a base protective layer 281 mainly composed of $SiO_2$ is formed on the surface of the element substrate 2 as a base and a silicon layer 241 is formed thereon. A gate insulating layer 282 mainly composed of $SiO_2$ and/or SiN is formed on the surface of the silicon layer 241.

Moreover, in the silicon layer 241, a region which superposes a gate electrode 242 through the gate insulating layer 282 is a channel region 241*a*. Furthermore, the gate electrode 242 is a portion of a scan line (not illustrated). Meanwhile, a first interlayer insulating layer 283 mainly composed of $SiO_2$ is formed on the surface of the gate insulating layer 282 covering the silicon layer 241 and having the gate electrode 242.

Furthermore, in the silicon layer 241, a low concentration source region 241*b* and a high concentration source region 241S are provided at the source side of the channel region 241*a*, and a low concentration drain region 241*c* and a high concentration drain region 241D are provided at the drain side of the channel region 241*a*, thereby forming a lightly doped drain (LDD) configuration. Among them, the high concentration source region 241S is connected to a source electrode 243 through a contact hole 243*a* perforated in the first interlayer insulating 283 and the gate insulating layer 282. This source electrode 243 composes a portion of a power supply line (not illustrated). Meanwhile, the high concentration drain region 241D is connected to a drain electrode 244 formed in the same layer as that of the source electrode 243 through a contact hole 244*a* perforated in the first interlayer insulating layer 283 and the gate insulating layer 282.

A planarization layer 284 mainly composed of, for example, acrylic resin, is formed on the first interlayer insulating layer 283 having the source electrode 243 and the drain electrode 244. The planarization layer 284 is formed of a heat-resistance insulating resin such as acrylic or polyimide and removes irregularities due to the driving TFT 123 (driving element 4), the source electrode 243, and the drain electrode 244.

In addition, the pixel electrode 23 composed of ITO is formed on the surface of the planarization layer 284 and connected to the drain electrode 244 through the contact hole 23*a* provided in the planarization layer 284. That is, the pixel electrode 23 is connected to the high concentration drain region 241D of the silicon layer 241 through the drain electrode 244.

An inorganic barrier rib 25 are formed on the surface of the planarization layer 284 having the pixel electrode 23, and an organic barrier rib 221 is formed on the inorganic barrier rib 25. In addition, on the pixel electrode 23, the hole transport layer 70 and the light emission layer 60 are sequentially laminated in an opening 25*a* formed in the inorganic barrier rib 25 and an opening 221*a* formed in the organic barrier rib 221, that is, a pixel region, in this order from the pixel electrode 23, thereby forming a function layer.

Moreover, in this embodiment, although the driving element 4 such as TFT is formed on the element substrate 2 as an element for driving the EL element, the driving element 4 may be externally attached, not formed on the element substrate 2. In more detail, a driver IC may be COG-mounted in a terminal region of the EL element substrate or a flexible circuit board in which a driver IC is mounted may be mounted on the EL element substrate.

As illustrated in FIG. 1, the line head module 101 having the above-referenced configuration irradiates the light onto the photosensitive drum 9 to form an image. At this time, since the line head 1 and the lens array 31 are integrally held to be aligned with each other, only the line head module 101 is aligned with the photosensitive drum 9 upon the use. Accordingly, in the exposure apparatus 100 including the line head module 101, the alignment with the photosensitive drum 9 is more easily performed, compared with a case where the line head 1 and the lens array 31 are separately prepared. Thus, it is possible to surely prevent exposure unevenness due to alignment failure.

As described above, in the present embodiment, the plurality of line heads 1 (that is, light emission element row 3A) is assigned to one photosensitive drum 9. Accordingly, it is possible to increase the life span of the line head as the module and perform printing with a high speed and a great amount of the light. Moreover, since the line heads 1 are switched by rotating the support 10, the size of the line head module 101 is reduced and thus the exposure apparatus 100 and the image forming apparatus including the exposure apparatus 100 as the exposure unit can be minimized.

Next, an image forming apparatus including the exposure apparatus according to the above-referenced embodiment as an exposure unit will be described.

Tandem Type Image Forming Apparatus

Figure 7:
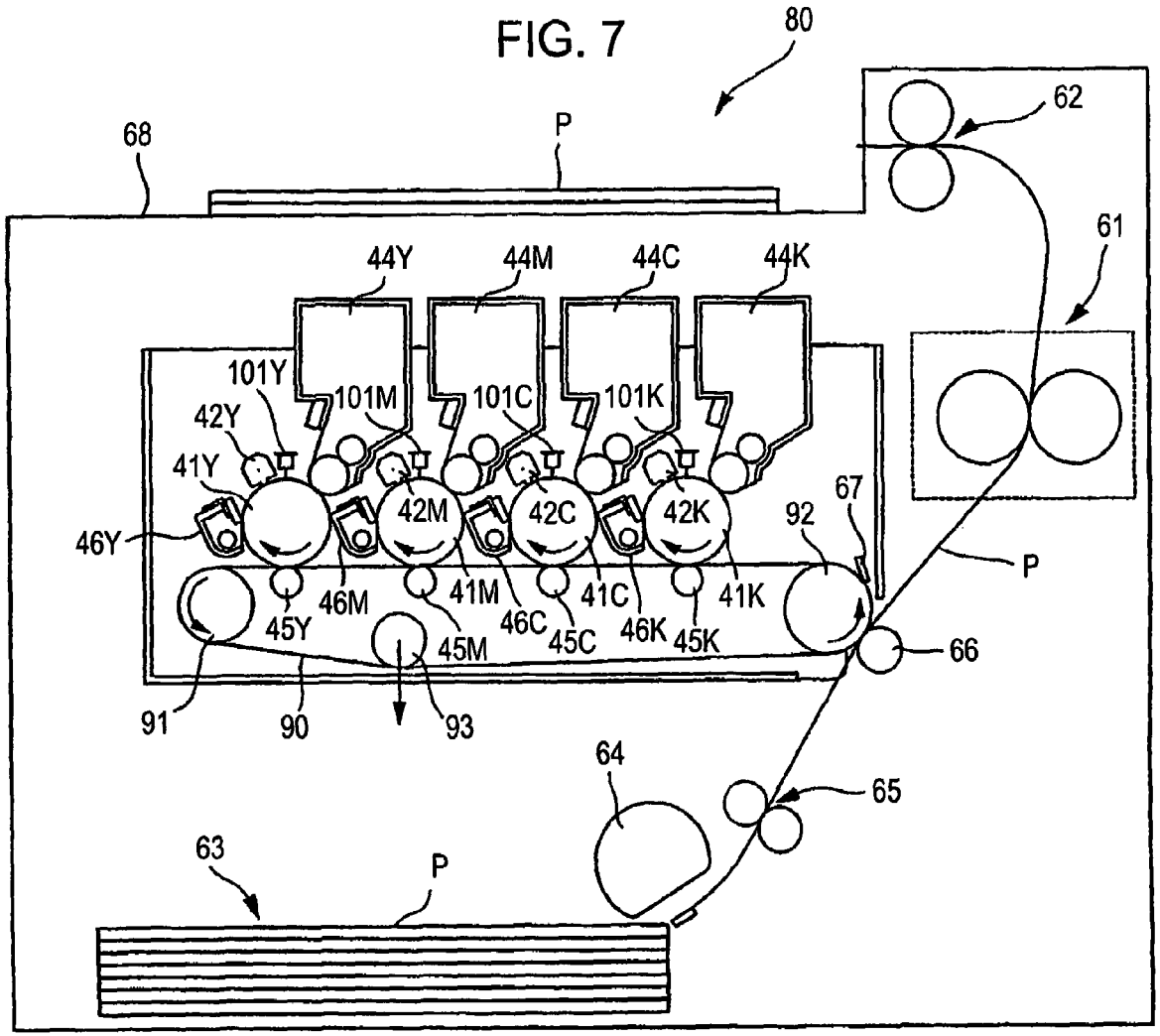
FIG. 7 schematically illustrates an image forming apparatus according to a first embodiment of the invention.

FIG. 7 illustrates an image forming apparatus according to a first embodiment of the invention. In FIG. 7, reference numeral 80 is a tandem type image forming apparatus. The image forming apparatus 80 includes the exposure apparatus formed by arranging organic EL array line heads 101K, 101C, 101M, and 101Y to four photosensitive drums 41K, 41C, 41M, and 41Y, respectively.

The image forming apparatus 80 includes a driving roller 91, a driven roller 92, and a tension roller 93, and an intermediate transfer belt 90 is stretched over the rollers by tension and rotates in a direction indicated by an arrow (counterclockwise direction) of FIG. 7. In addition, the photosensitive drums 41K, 41C, 41M, and 41Y are arranged at a predetermined interval with respect to the intermediate transfer belt 90. Photosensitive layers are formed on the outer circumferential surfaces of the photosensitive drums 41K, 41C, 41M, and 41Y as carriers.

Here, K, C, M, Y in reference numerals indicate black, cyan, magenta, and yellow, respectively. Accordingly, 41K, 41C, 41M, and 41Y denote the photosensitive bodies for black, cyan, magenta, and yellow, respectively. In addition, reference numerals K, C, M, and Y are similarly used in the other members. The photosensitive drums 41K, 41C, 41M, and 41Y rotate in a direction indicated by an arrow (clockwise direction) of FIG. 7 in synchronization with the driving of the intermediate transfer belt 90.

In the vicinities of the photosensitive drums 41K, 41C, 41M, and 41Y, charging units (corona chargers) 42(K, C, M, and Y) for uniformly charging the outer circumferential surfaces of the photosensitive drums 41(K, C, M, and Y) and organic EL array line head 101(K, C, M, and Y) for sequentially line-scanning the outer circumferential surfaces which are uniformly charged by the charging units 42(K, C, M, and Y) in synchronization with the rotation of the photosensitive drums 41(K, C, M, and Y) are provided.

Here, as described above, the organic EL array line heads 101(K, C, M, Y) are integrally held in the state that they are aligned with the SL arrays (not illustrated) by a head case to be used as the line head module.

Moreover, developing devices 44(K, C, M, and Y) for supplying toners, which are developing agents, onto electrostatic latent images formed on the organic EL array line heads 101(K, C, M, and Y) (line head module) to form visible images (toner images), primary transfer rollers 45(K, C, M, and Y) for sequentially transferring the toner images formed on the developing devices 44(K, C, M, and Y) onto the intermediate transfer belt 90 which is a primary transfer target, and cleaning devices 46(K, C, M, Y) for removing toners remaining on the surfaces of the photosensitive drums 41(K, C, M, and Y) after transferring are provided.

Here, the organic EL array line heads 101(K, C, M, and Y) are formed along the lines of the photosensitive drums 41(K, C, M, and Y). Furthermore, the light emission energy peak wavelengths of the organic EL array line heads 101(K, C, M, and Y) are set to be substantially equal to sensitivity peak wavelengths of the photosensitive drums 41(K, C, M, and Y).

The developing devices 44(K, C, M, and Y) use, for example, nonmagnetic one-component toners. The one-component developing agents are carried to developing rollers, for example, by feeding rollers and the film thicknesses of the developing agents attached to the surfaces of the developing rollers are controlled by control blades. The developing rollers contact or press the photosensitive drums 41(K, C, M, and Y) such that the developing agents are attached to the electrostatic latent images formed on the photosensitive drums 41(K, C, M, and Y) in accordance with their potential levels, thereby forming the toner images.

The toner images of black, cyan, magenta, and yellow formed by four-color toner image forming stations are primarily transferred onto the intermediate transfer belt 90 in sequence by primary transfer biases applied to the primary transfer rollers 45(K, C, M, Y). Then, the full-color toner image formed by sequentially superposing the images on the intermediate transfer belt 90 is secondarily transferred onto a recording medium P such as a sheet of paper and the recording medium P passes through a pair of fixing rollers 61 which is a fixing unit such that the toner image is fixed on the recording medium P. Thereafter, the recording medium P is discharged on a discharge tray 68 provided at the upper side of the apparatus by a pair of ejection rollers 62.

In addition, reference numeral 63 of FIG. 7 denotes a sheet feeding cassette in which a plurality of recording mediums P are contained, reference numeral 64 denotes a pickup roller for feeding the recording medium P from the sheet feeding cassette 63 one by one, reference numeral 65 denotes a pair of gate rollers for controlling a timing of feeding the recording medium P to a secondary transfer unit of the secondary transfer roller 66, reference numeral 66 denotes a second transfer roller which configures the secondary transfer unit with the intermediate transfer belt 90 as a secondary transfer means, and reference numeral 67 denotes a cleaning blade for removing the toner remaining on the surface of the intermediate transfer belt 90 after secondary transferring.

Four-Cycle Type Image Forming Apparatus

Figure 8:
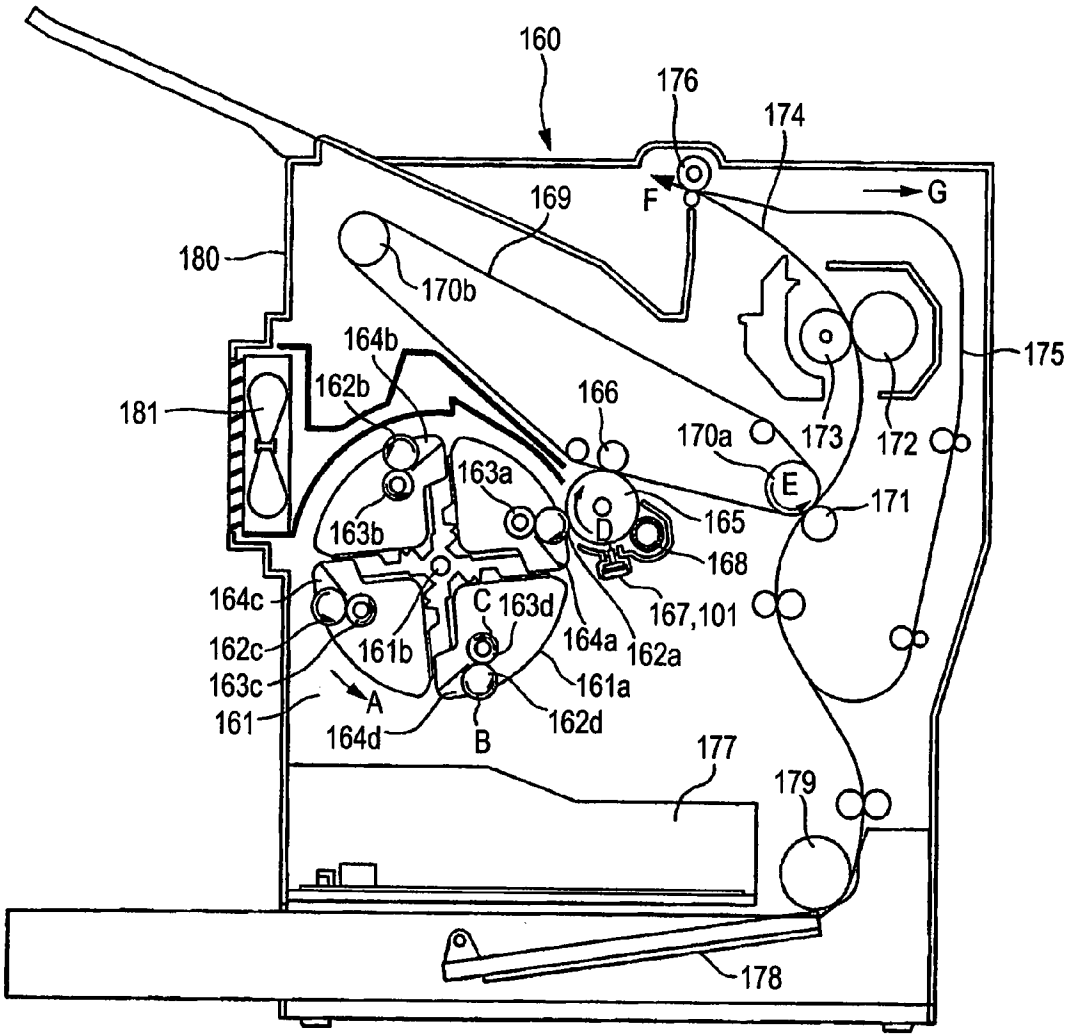
FIG. 8 schematically illustrates an image forming apparatus according to a second embodiment of the invention.

Next, an image forming apparatus according to a second embodiment of the invention will be described. FIG. 8 is a longitudinal cross-sectional view of a four-cycle type image forming apparatus. In FIG. 8, the image forming apparatus 160 mainly includes a rotary-type developing device 161, a photosensitive drum 165 which functions as an image carrier, an image writing unit 167 including the line head module, an intermediate transfer belt 169, a sheet transportation path 174, a heating roller 172 of a fixing unit, and a sheet feeding tray 178.

The developing device 161 is configured such that a developing rotary 161*a* rotates about an axis 161*b* in a direction indicated by an arrow A. The inside of the developing rotary 161*a* is divided into four segments, in which image forming units for four colors, including yellow (Y), cyan (C), magenta (M), and black (K) are formed, respectively. Reference numerals 162*a* through 162*d* are developing rollers which are placed in the respective image forming units for four colors and rotate in a direction indicated by an arrow B. Reference numerals 163*a* through 163*d* are toner supply rollers which rotates in a direction indicated by an arrow C. Reference numerals 164*a* through 164*d* are control blades which restrict the thicknesses of toners to predetermined thicknesses.

In FIG. 8, reference numeral 165 denotes a photosensitive drum which functions as an image carrier, reference numeral 166 denotes a primary transfer member, reference numeral 168 denotes a charger, and reference numeral 167 denotes the line head module as an image writing unit. In addition, the photosensitive drum 165 and the image writing unit (line head module) 167 configure the exposure apparatus of the invention.

The photosensitive drum 165 rotates by a driving motor (not shown) such as a step motor, in a direction indicated by an arrow D, which is opposite to the direction of the developing roller 162*a*. In addition, the line head module configuring the image writing unit 167 is placed in alignment (alignment of optical axis) with the photosensitive drum 165.

The intermediate transfer belt 169 is stretched over a driving roller 170*a* and a driven roller 170*b*. The driving roller 170*a* is linked to a driving motor of the photosensitive drum 165 and delivers power to the intermediate transfer belt 169. That is, by driving the driving motor, the driving roller 170*a* of the intermediate transfer belt 169 rotates in a direction indicated by an arrow E, which is opposite to the direction of the photosensitive drum 165.

The sheet transportation path 174 is provided with a plurality of transportation rollers and a pair of ejection rollers 176 so that the sheet is carried. The image (toner image) carried by the intermediate transfer belt 169 is transferred onto one surface of a sheet of paper at the position of the secondary transfer roller 171. The secondary transfer roller 171 contacts the intermediate transfer belt 169 by clutch. That is, the secondary transfer roller 171 contacts the intermediate transfer belt 169 by turning on the clutch to transfer the image onto the sheet of paper.

The sheet of paper, onto which the toner image has been transferred as described above, is then subjected to fixing processing by the fixing unit having a fixing heater H. The fixing unit is provided with a heating roller 172 and a press roller 173. After the fixing processing, the sheet of paper is pulled into the pair of ejection rollers 176 to travel in a direction indicated by an arrow F. When the pair of ejection rollers 176 rotates in an inverse direction from this state, the sheet of paper inverts the direction and travels in a direction indicated by an arrow G through a double-sided print transportation path 175. Reference numeral 177 denotes an electrical equipment box, reference numeral 178 denotes a sheet feeding tray for containing the sheet of paper, and reference numeral 179 denotes a pickup roller provided at the outlet of the sheet feeding tray 178. For the sheet transportation path, for example, a low-speed brushless motor is used as the driving motor for driving the transportation rollers. Also, a step motor is used for the intermediate transfer belt 169, since correction such as color shift is required. These motors are controlled by signals from a control unit (not illustrated).

In the state illustrated in FIG. 8, an electrostatic latent image of yellow (Y) is formed on the photosensitive drum 165, and an image of yellow is formed on the photosensitive drum 165 when a high voltage is applied to the developing roller 162*a*. When images of yellow on the rear surface and the front surface are entirely carried over onto the intermediate transfer belt 169, the developing rotary 161*a* rotates by 90 degrees in a direction indicated by the arrow A.

The intermediate transfer belt 169 rotates once and returns to the position of the photosensitive drum 165. Next, images of cyan (C) on two surfaces are then formed on the photosensitive drum 165, which are carried over to be superimposed on the images of yellow carried on the intermediate transfer belt 169. Thereafter, the processing is repeated in the same manner, so that the developing rotary 161*a* rotates by 90 degrees and the intermediate transfer belt 169 rotates once after the images are carried over.

For images of four colors to be carried over, the intermediate transfer belt 169 rotate four times, and the rotational position is controlled such that the image is transferred onto a sheet of paper at the position of the secondary transfer roller 171. The sheet of paper fed from the sheet feeding tray 178 is transported through the transportation path 174, and the color image is transferred onto one surface of the sheet of paper at the position of the secondary transfer roller 171. The sheet of paper, onto which the image is transferred at one surface, is inverted by the pair of ejection rollers 176 as described above, and stands by in the transportation path. Subsequently, the sheet of paper is transported to the position of the secondary transfer roller 171 at the adequate timing, and the color image is transferred onto the other surface. A housing 180 is provided with an exhaust fan 181.

In the image forming apparatuses 80 and 160 illustrated in FIGS. 7 and 8, the exposure apparatus of the invention illustrated in FIG. 1 is used as the exposure unit.

Accordingly, as described above, in the image forming apparatuses 80 and 160, it is possible to ensure sufficient life span by the switch of the line head and perform high-speed printing.

Another embodiment of the exposure apparatus of the invention will be described. The basic configuration of the exposure apparatus is the same as that of the exposure apparatus illustrated in FIG. 1 and thus its description will be omitted.

Line Head Module

Figure 9A:
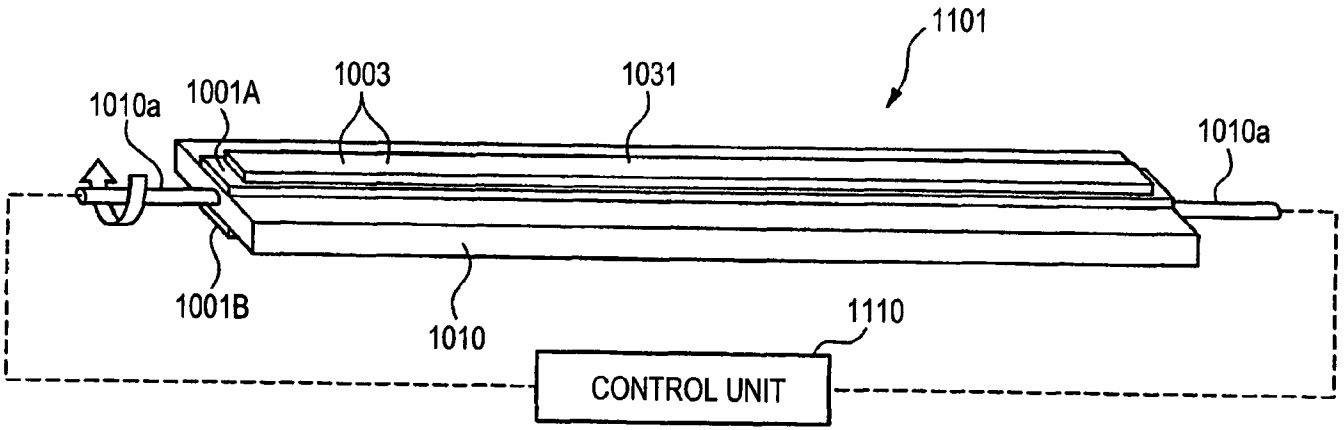
FIG. 9A is a perspective view of a line head module according to another embodiment and FIG. 9B is a cross-sectional view thereof.
Figure 9B:
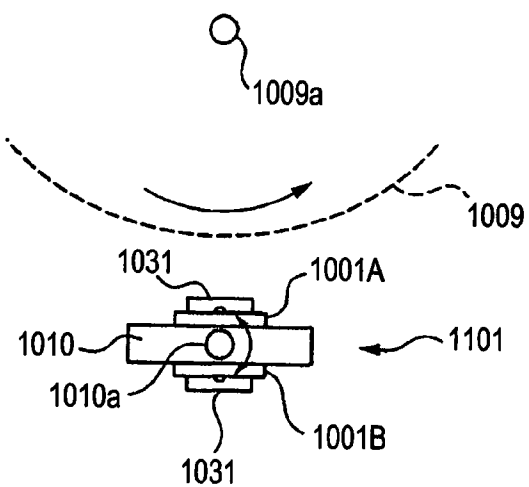

FIGS. 9A and 9B schematically illustrates a configuration of a line head module 1101 according to the present embodiment, where FIG. 9A is a perspective view thereof and FIG. 9B is a cross-sectional view thereof.

As illustrated in FIGS. 9A and 9B, the line head module 1101 includes line heads 1001 (1001A and 1001B) on which a plurality of light emission elements 1003 are arrayed, lens arrays 1031 on which a lens element for imaging the light from the line heads 1001, and a support 1010 for supporting the line heads 1001.

In FIGS. 9A and 9B, the support 1010 is formed in a plate shape, and a rotation axis 1010*a*, which extends in a direction parallel to its main surface, is provided at the center of the support 1010. The rotation axis 1010*a* is connected to a control unit 1110 and the rotation of the support 1010 is controlled by a control signal from the control unit 1110. The line heads 1001 (1001A and 1001B) are provided on a plurality of peripheral surfaces which are arranged in the peripheral direction of the support 1010, that is, the front and rear surfaces of the support 1010. The two line heads 1001A and 1001B are switched by rotating the support 1010 about the rotation axis 1010*a*. In addition, the driving of the line heads 1001A and 1001B is switched by switching the line heads 1001A and 1001B. That is, while one line head is selected, the other line head is not driven.

The line heads 1001A and 1001B have different specifications and are switched by a user's request. For example, the line head 1001A (low definition and high speed) has an image forming area of 100 μm (low definition) and an output speed of 40 ppm (high speed), while the line head 1001B (high definition and low speed) has an image forming area of 50 μm (high definition) and an output speed of 20 ppm (low speed). In the output such as line image which does not require high definition, the line head 1001A is used such that the high-speed output is performed. On the contrary, in the output which requires high definition, such as a photograph, the support 1010 rotates about the rotation axis 1010*a* by the control unit 1110 by 180 degrees such that the line head 1001B is used. Accordingly, the printing speed slightly becomes slower, but the output having high image quality can be performed. The switch of the line heads 1001 is automatically performed by the control unit 1110.

Figure 10A:
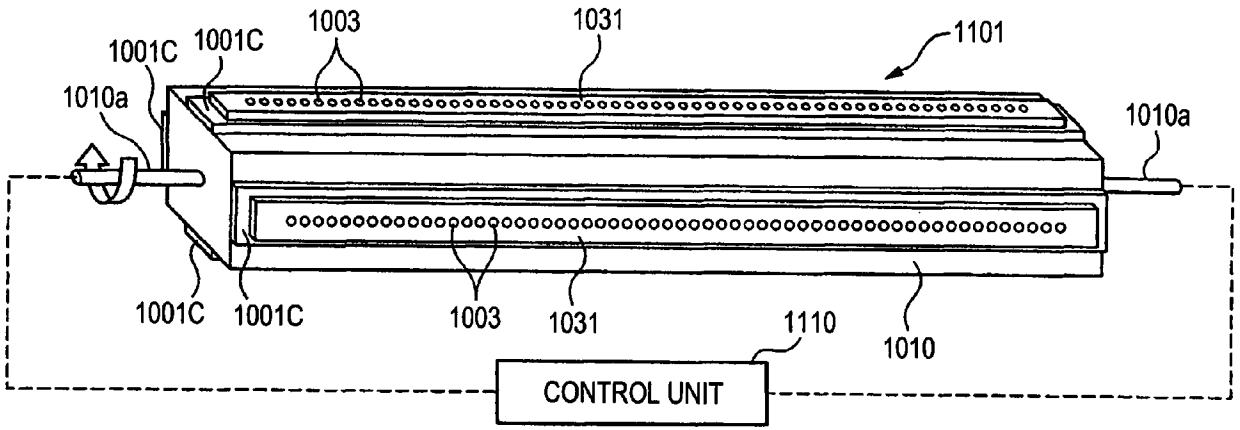
FIG. 10A is a perspective view illustrating another configuration of the line head module and FIG. 10B is a cross-sectional view thereof.
Figure 10B:
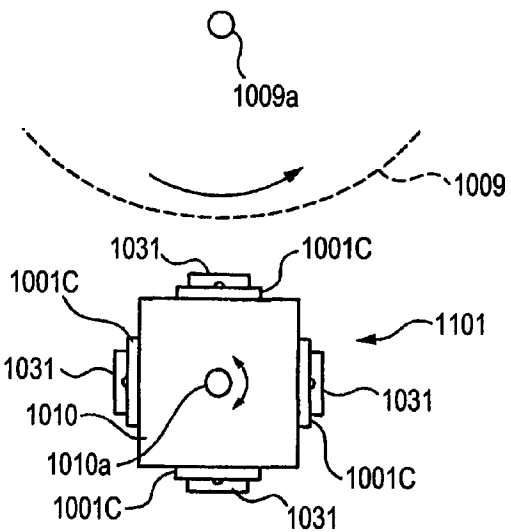

FIGS. 10A and 10B illustrate another configuration of the line head module 1101 and correspond to FIGS. 9A and 9B, respectively.

In the line head module 1101 of FIGS. 10A and 10B, the support 1010 is formed in a square column shape. A rotation axis 1010*a* parallel to a rotation axis 1009*a* of a photosensitive drum 1009 is provided at the center of the support 1010. The rotation axis 1010*a* is connected to the control unit 1110 and the rotation of the support 1010 is controlled by a control signal from the control unit 1110. Line heads 1001 (1001C and 1001D) are provided on a plurality of peripheral surfaces which are arranged in the peripheral direction of the support 1010, that is, the four side surfaces of the support 1010. The line heads 1001C and 1001D are switched by rotating the support 1010 about the rotation axis 1010*a*. The line heads 1001 are switched by rotating the support 1010 about the rotation axis 1010*a* by 90°. In addition, the driving of the plurality of line heads 1001C and 1001D is switched by switching the line heads 1001. That is, while any one line head is selected, the other line heads 1001 are not driven.

The line heads 1001C and 1001D have different specifications and are switched by a user's request. For example, the line head 1001C (low definition, high light amount/general color) has a specification (for example, an image forming area of 100 μm and an output speed of 40 ppm), which can process the output which does not relatively require high definition, such as a monochromic or multi-color line image or picture which is frequently used. Since the line head 1001C is frequently used and thus apt to be deteriorated, three line heads 1001C are equipped. The line heads 1001C are switched when the light amount of the light emission element 1003 included in the line head 1001C is reduced. When the light amount of the light emission element 1003 is insufficient upon the exposure of the photosensitive drum 1009, the control unit 1110 rotates the support 1010 about the rotation axis 1010*a* by 90 degrees such that another line head 1001C can be used. The reduction in the light amount may be directly detected using a sensor or determined based on a print condition (the light amount, the print speed, or the like) or the print number. It is preferable that the line heads 1001C are automatically switched depending on the reduction in the light amount.

The line head 1001D (high definition, low light amount/photograph image) has a specification corresponding to the output such as a photograph which requires high definition (for example, an image forming area of 50 μm and an output speed of 20 ppm). The line head 1001D has a low printing speed, but can perform the output having high image quality. Since the line head 1001D is not frequently used, one line head 1001D is equipped.

In addition, in FIGS. 10A and 10B, although the line heads 1001 are provided on all the side surfaces of the support 1010, the line heads 1001 need not be necessarily provided on all the side surfaces. That is, the line heads 1001 may be provided on only two or three of the four side surfaces. Furthermore, as the support 1010, a polygonal column such as a triangular column, a pentagonal column, or a hexagonal column may be used. The line heads 1001 may be provided on at least two side surfaces of the polygonal column. Moreover, as the support 1010, a column having curved surfaces at a portion thereof, such as a circular column or an elliptical column, may be used. In the column such as the circular column or the polygonal column, in order to standardize the lens arrays 1031, it is preferable that the cross-sectional shape of the column has a regular polygonal shape or circular shape. In addition, in FIGS. 10A and 10B, although the support 1010 is a solid column, the support 1010 may be a hollow column.

Furthermore, in FIGS. 10A and 10B, although a ratio of the number of the line heads 1001C to the number of the line heads 1001D is 3:1, the ratio is not limited to this. In a printer for outputting a photograph, the number of the line heads 1001D may increase. In addition, four line heads may have respective different specifications such that an optimal line head is automatically selected in all use cases.

Moreover, in the present embodiment, although the definition, the output light amount, and the output speed are listed as the specifications of the line heads 1001, the specifications are not necessarily limited to these.

As the lens arrays 1031 of the present embodiment, the SL arrays are used, similar to the lens array 31 of the first embodiment, and thus its description will be omitted.

Line Head

The basic configuration of the line head 1001 according to the present embodiment is the same as that of the line head 1 illustrated in FIG. 4 and thus its description will be omitted.

Organic EL Element and Driving Element

The basic configuration of the organic EL element or the driving element of the line head 1001 according to the present embodiment is the same as that of the organic EL element or the driving element illustrated in FIGS. 6A and 6B and thus its description will be omitted.

As described above, in the present embodiment, the plurality of line heads 1001 (that is, light emission element row 1003A is assigned to one photosensitive drum 1009. Accordingly, it is possible to increase the life span of the line head and perform printing with a high speed and a great amount of the light. Moreover, since the line heads 1001 are switched by rotating the support 1010, the size of the line head module 1101 is reduced and thus the exposure apparatus 1100 and the image forming apparatus including the exposure apparatus 1100 as an exposure unit can be minimized. In addition, since the line heads having a plurality of different specifications are provided on the same support 1010, it is possible to obtain the output corresponding to the a user's request by switching the line heads depending on a use thereof. Furthermore, by switching the line heads 1001, the respective line heads 1001 can be efficiently utilized and an output apparatus such as a printer has a high specification.

Next, an image forming apparatus including the exposure apparatus according to the above-referenced embodiment as an exposure unit will be described.

Tandem Type Image Forming Apparatus

Figure 11:
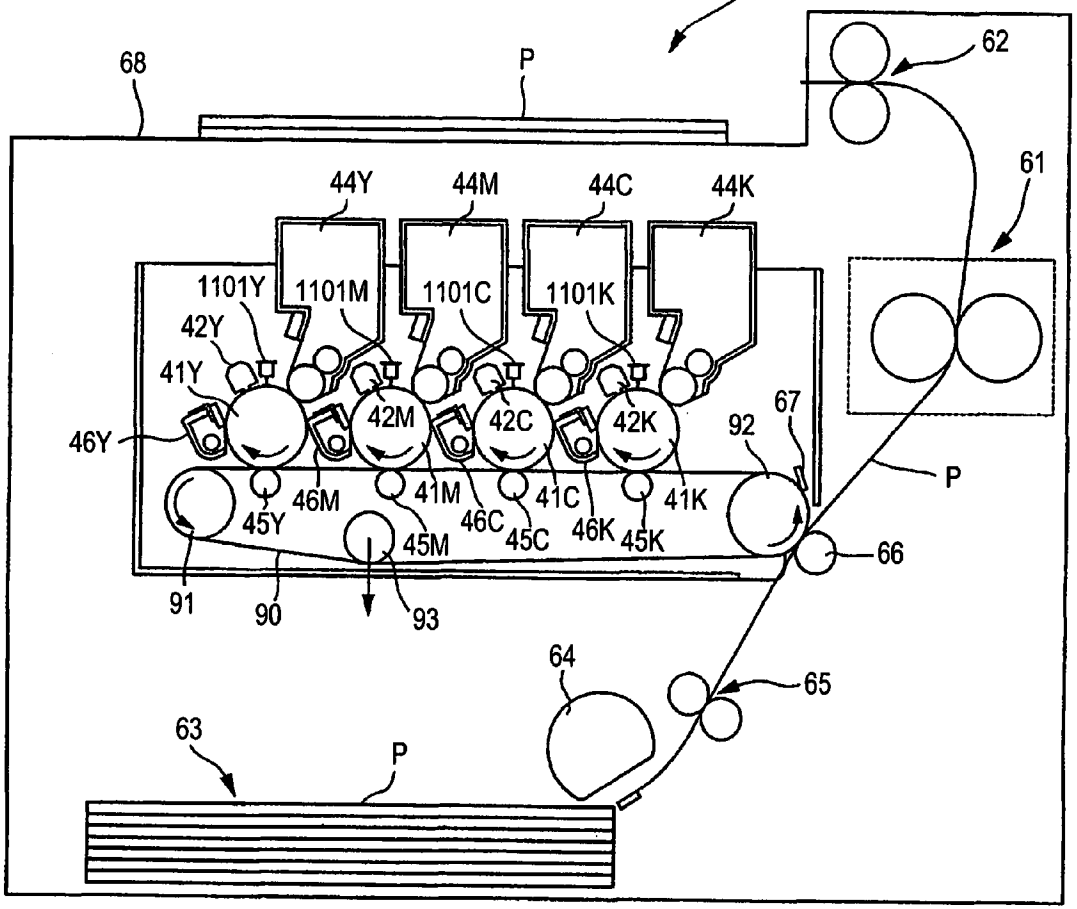
FIG. 11 schematically illustrates an image forming apparatus according to a third embodiment of the invention.

FIG. 11 illustrates an image forming apparatus according to a third embodiment of the invention. In FIG. 11, reference numeral 1080 is a tandem type image forming apparatus. The image forming apparatus 1080 has the same configuration as that of the image forming apparatus illustrated in FIG. 7, except that the exposure apparatus is configured by arranging the organic EL array line heads 1101K, 1101C, 1101M, and 1101Y of the above-referenced embodiment to four photosensitive drums 41K, 41C, 41M, and 41Y, respectively. Accordingly, the same elements are denoted by the same reference numerals and their description will be omitted.

Four-Cycle Type Image Forming Apparatus

Figure 12:
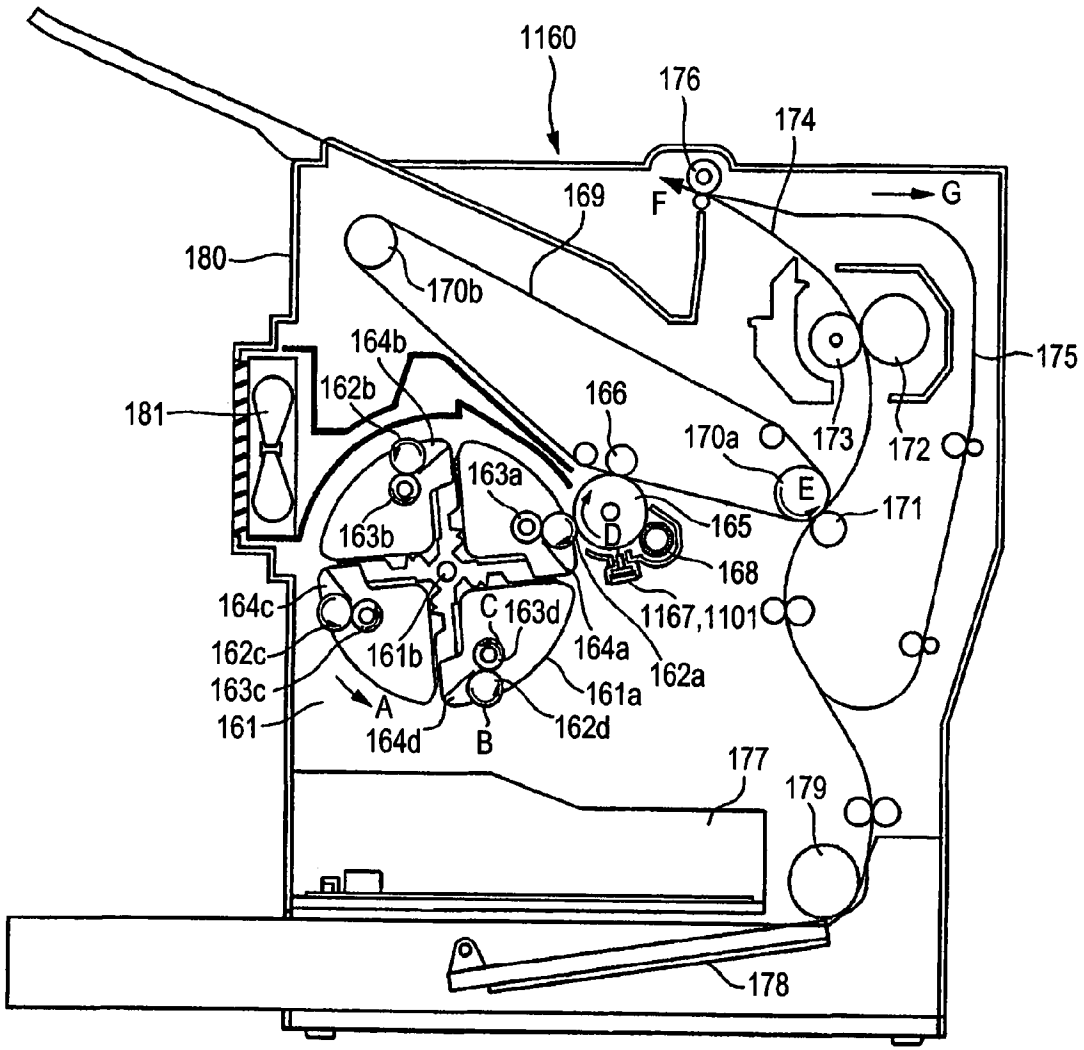
FIG. 12 schematically illustrates an image forming apparatus according to a fourth embodiment of the invention.

Next, an image forming apparatus of a fourth embodiment of the invention will be described. FIG. 12 is a longitudinal cross-sectional view of a four-cycle type image forming apparatus 1160. The image forming apparatus 1160 has the same configuration as that of the image forming apparatus illustrated in FIG. 8, except that the line head module 1101 according to the above-referenced embodiment is used in an image writing unit 1167. Accordingly, the same elements are denoted by the same reference numerals and their description will be omitted.

In the image forming apparatuses 1080 and 1160 illustrated in FIGS. 11 and 12, the exposure apparatus of the invention illustrated in FIG. 1 is included as an exposure unit.

Accordingly, in the image forming apparatuses 1080 and 1160, as described above, by switching the line heads, it is possible to ensure sufficient life span and perform high-speed printing.

Moreover, since a plurality of line heads having different specifications are provided in one line head module, the line heads can be efficiently utilized and thus the line head module has a high specification.

An exposure apparatus of another embodiment of the invention will be described. The basic configuration of the exposure apparatus is the same as that of the exposure apparatus illustrated in FIG. 1 and thus its description will be omitted.

Line Head Module

Figure 13A:
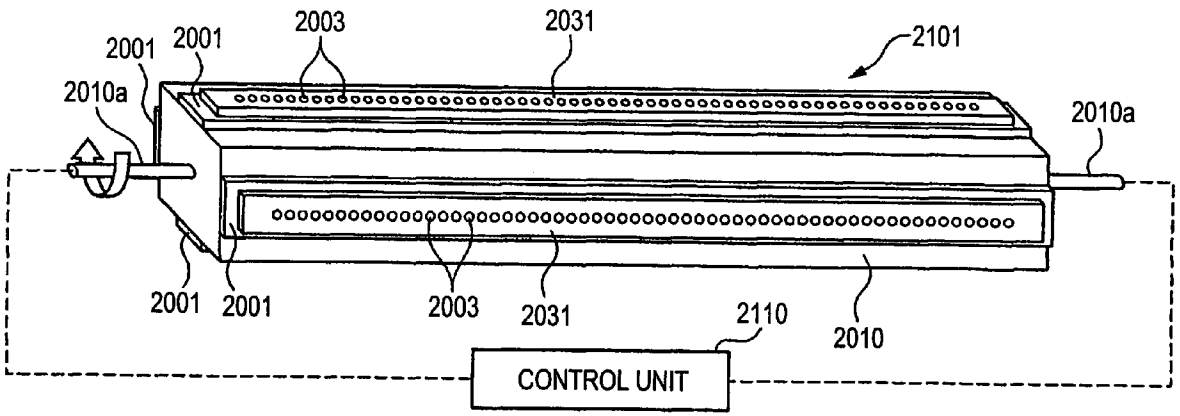
FIG. 13A is a perspective view of a line head module according to another embodiment.
Figure 13B:
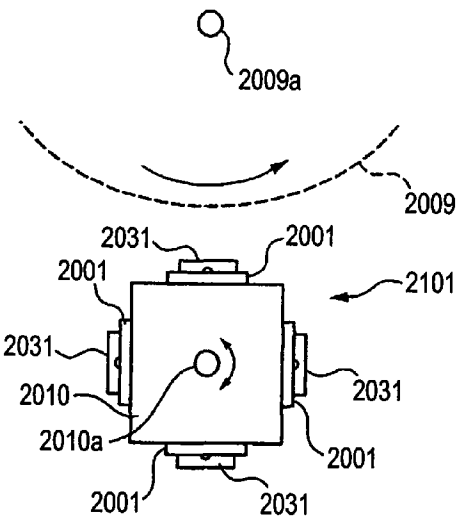
FIG. 13B is a cross-sectional view thereof.

FIGS. 13A and 13B schematically illustrate a configuration of a line head module 2101, where FIG. 13A is a perspective view thereof and FIG. 13B is a cross-sectional view thereof.

AS illustrated in FIGS. 13A and 13B, the line head module 2101 includes line heads 2001 on which a plurality of light emission elements 3 are arrayed, lens arrays 2031 on which lens elements for imaging the light from the line head 2001 are arrayed, and a support 2010 for supporting the line heads 2001.

In FIGS. 13A and 13B, the support 2010 is formed in a square column shape. A rotation axis 2010*a* parallel to a rotation axis 2009*a* of a photosensitive drum 2009 is provided at the center of the support 2010. The rotation axis 2010*a* is connected to a control unit 2110 and the rotation of the support 2010 is controlled by a control signal from the control unit 2110. Line heads 2001 are provided on a plurality of peripheral surfaces which are arranged in the peripheral direction of the support 2010, that is, the four side surfaces of the support 2010. The line heads 2001 are switched by rotating the support 2010 about the rotation axis 2010*a*. In addition, the driving of the plurality of line heads 2001 is switched by switching the line heads 2001. That is, while any one line head 2001 is selected, the other line heads 2001 are not driven.

The line heads 2001 are switched, for example, depending on the reduction in the amount of the light emitted from the light emission element 2003 included in the line head 2001. In a case where the light amount of the light emission element 2003 is insufficient upon the exposure of the photosensitive drum 2009, the control unit 2110 rotates the support 2010 by 90° about the rotation axis 2010*a* such that another line head 2001 can be used. The reduction in the light amount may be directly detected using a sensor or determined based on a print condition (the light amount, a print speed, or the like) or the print number. It is preferable that the line heads 2001 are automatically switched depending on the reduction in the light amount. For example, in a case where one line head 2001 can print two hundred thousand sheets at a speed of 20 ppm, the control unit 2110 may be programmed such that, when the print number becomes two hundred thousands, the support 2010 automatically rotates about the rotation axis 2010*a* by 90° and thus another line head 2001 can be used. By this configuration, the image forming apparatus can print eight hundred thousand sheets.

Figure 14:
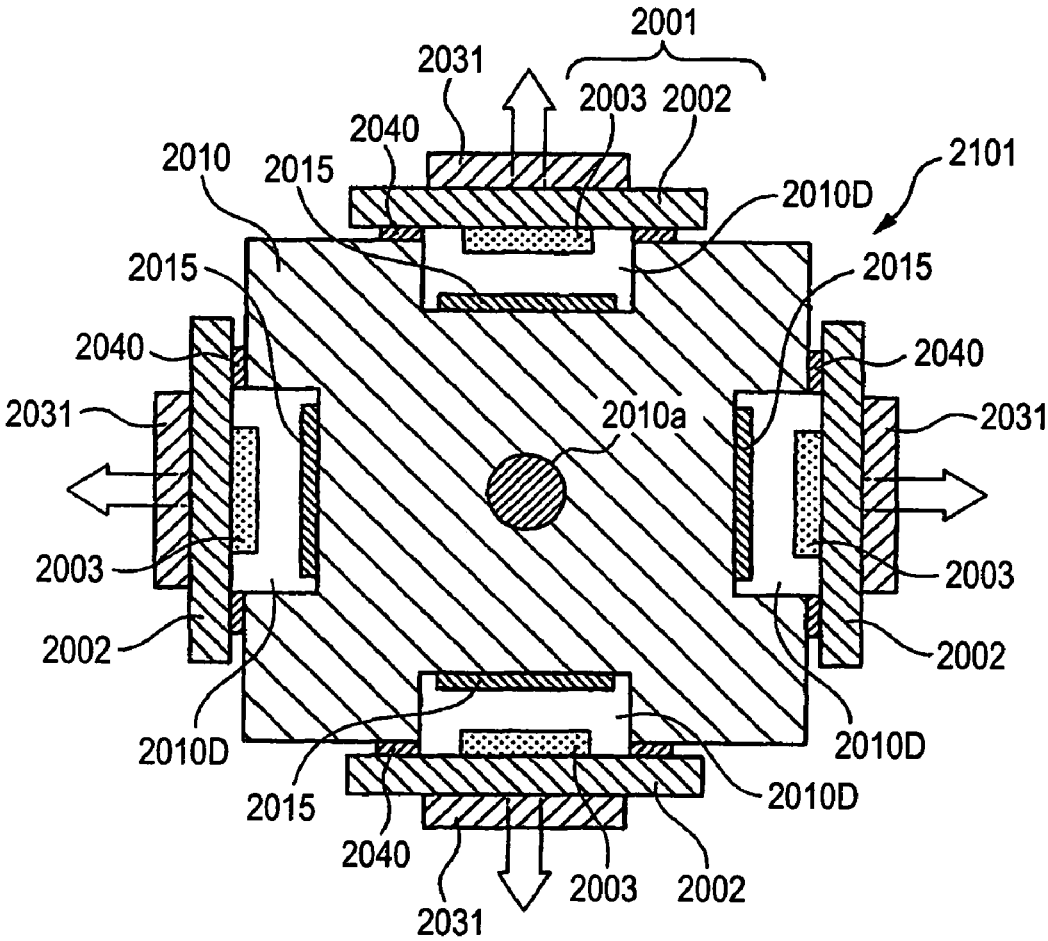
FIG. 14 is an enlarged cross-sectional view of FIG. 13B.

FIG. 14 is an enlarged cross-sectional view of the line head module 2101.

As illustrated in FIG. 14, the surfaces of the line heads 2001, on which the light emission elements 2003 are formed, are supported by the support 2010 and the line heads 2001 are adhered to the support 2010 by an adhesive 2040 which is provided at the edges of the element substrate 2002 in a ring shape. Concave portions 2010D are provided in four side surfaces of the support 2010 at positions facing the light emission elements 2003 of the line heads 2001, and the light emission elements 2003 are received in the concave portions 2010D. As described below, in the present embodiment, the EL element is used as the light emission element 2003 and the support 2010 functions as a sealing can (sealing member) for sealing the EL element. In addition, in the present embodiment, since the light emission elements 2003 are arrayed in a direction, the concave portions 2010D are formed with a regular width and length in correspondence with the light emission element row. The concave portion 2010D has a size less than the size of the line heads 2001 and a sealed space is formed between the line head 2001 and the support 2010. In addition, in the sealed space, the light emission element 2003 is hermetically sealed (can-sealed). Moreover, a getter material 2015 for absorbing water, oxygen, or the like is provided on the bottom of the concave portion 2010D such that the light emission element 2003 is prevented from being deteriorated due to moisture or the like.

Such a can sealing configuration applies to an EL apparatus used in a display. Since such an EL apparatus must be thin, a can sealing substrate (glass substrate) must be also thin. Generally, it is difficult to form a digging configuration in a thin substrate, and the manufacturing cost increases. Meanwhile, since the line head used as the exposure unit has no such a limitation, a thick member can be used in the support 2010. In addition, since the plurality of line heads 2001 are mounted, the support is thick to some extents in order to ensure the strength thereof. Since the thick support 2010 has a larger strength and more easily manufactured, compared with the can sealing substrate having a small thickness, the manufacturing cost can decrease.

In addition, in the line head module 2101 according to the present embodiment, since the light from the light head 2001 is emerged from the opposite side of the support 2010, the support may not be transparent. Accordingly, cheaper metal member can be used as the support 2010 and thus the manufacturing cost can decrease.

Figure 15:
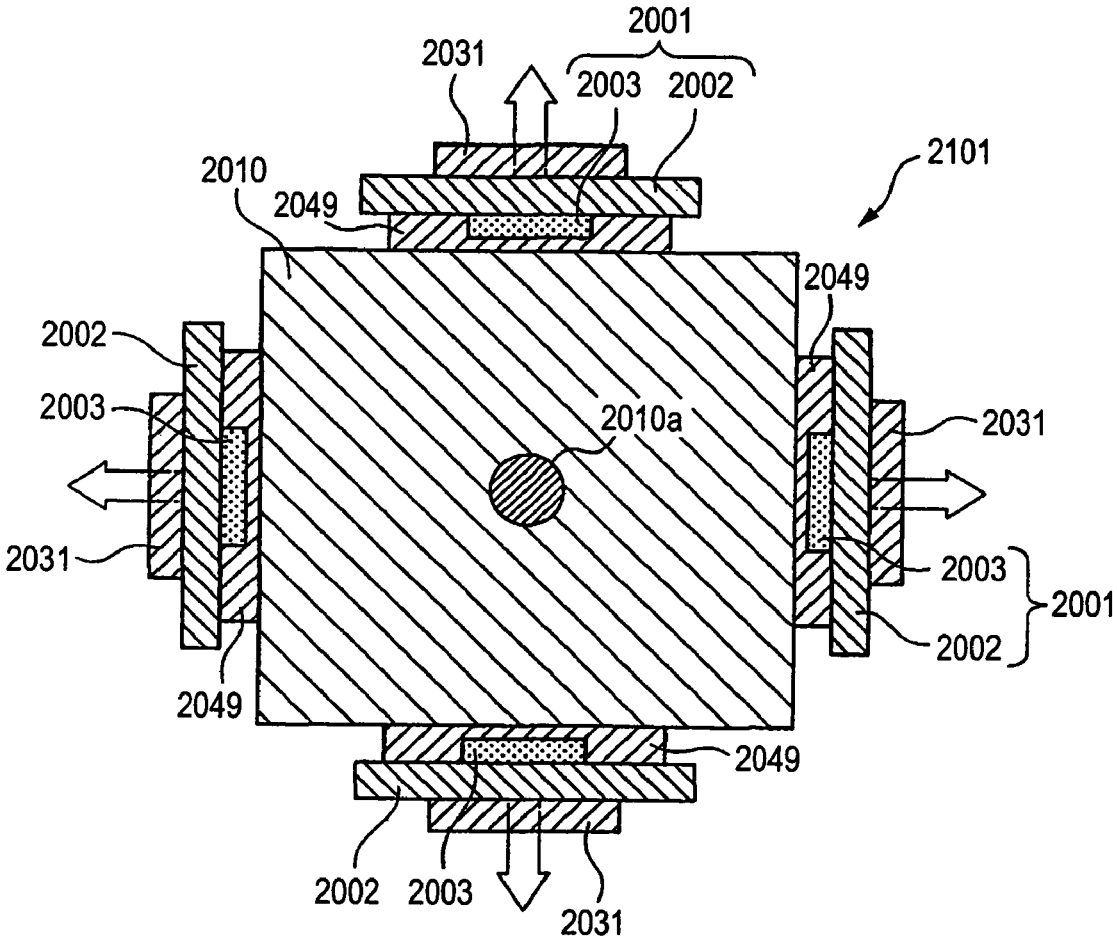
FIG. 15 is another enlarged cross-sectional view of FIG. 13B.

FIG. 15 illustrates another configuration of the line head module 2101 and corresponds to FIG. 14.

In the line head module 2101 illustrated in FIG. 15, the surfaces of the line heads 2001, on which the light emission element 2003 are formed, are supported by the support 2010 and the line heads 2001 are adhered to the side surfaces of the support 2010 by an adhesive layer 2049. The light emission element 2003 is solid-sealed by the adhesive layer 2049 and the support 2010. In this configuration, since a groove need not be formed in the support 2010, the manufacturing cost can more decrease, compared with that of FIG. 14.

In addition, in FIGS. 13A through 15, although the line heads 2001 are provided on all the side surfaces of the support 2010, the line heads 2001 need not be necessarily provided on all the side surfaces. That is, the line heads 2001 may be provided on only two or three of the four side surfaces. Furthermore, as the support 2010, a polygonal column such as a triangular column, a pentagonal column, or a hexagonal column may be used. The line heads 2001 may be provided on at least two side surfaces of the polygonal column. Moreover, as the support 2010, a column having curved surfaces at a portion thereof, such as a circular column or an elliptical column, may be used. In the column such as the circular column or the polygonal column, in order to standardize the lens arrays 2031, it is preferable that the cross-sectional shape of the column has a regular polygonal shape or circular shape. In addition, in FIG. 14, although the support 2010 is a solid column, the support 2010 may be a hollow column.

Furthermore, in the present embodiment, the plurality of line heads 2001 provided on the same support 2010 can be mutually used as spares. Accordingly, it is preferable that the line heads 2001 have the same specification. Alternatively, the line heads 2001 may have different specifications such that the line heads 2001 can complement one another.

As the lens arrays 2031 of the present embodiment, the SL arrays are used, similar to the lens array 31 of the first embodiment, and thus its description will be omitted.

Line Head

The basic configuration of the line head 2001 according to the present embodiment is the same as that of the line head 1 illustrated in FIG. 4 and thus its description will be omitted. In the present embodiment, an EL element is used as the light emission element 2003. Here, although, for example, an organic EL element is used, an inorganic EL element may be used.

Organic EL Element and Driving Element

The detailed configuration of the organic EL element or the driving element in the line head 2001 according to the present embodiment is the same as that of the organic EL element or the driving element illustrated in FIGS. 6A and 6B and thus its description will be omitted. In the present embodiment, since the support 2010 functions as a sealing member of the organic EL element 2003, the organic EL element 3 has a bottom emission type configuration that the light emitted from the light emission layer 60 is emerged from the pixel electrode 23.

As described above, in the present embodiment, the plurality of line heads 2001 (that is, light emission element row 2003A is assigned to one photosensitive drum 2009. Accordingly, it is possible to increase the life span of the line head as the module and perform printing with a high speed and a great amount of the light. Moreover, since the line heads 2001 are switched by rotating the support 2010, the size of the line head module 2101 is reduced and thus the exposure apparatus 2100 and the image forming apparatus including the exposure apparatus 2100 as an exposure unit can be minimized. In addition, since the support 2010 functions as a sealing member for sealing the EL elements 2003 of the line heads 2001, the member cost can more decrease, compared with a case where the sealing members are provided in the respective line heads 2001. Moreover, since the plurality of line heads 2001 are mounted on the support 2010 according to the present embodiment, the support must have a predetermined strength and thus has a sealing strength higher than that of a case of using a thin sealing substrate.

Next, an image forming apparatus including the exposure apparatus according to the above-referenced embodiment as an exposure unit will be described.

Tandem Type Image Forming Apparatus

Figure 16:
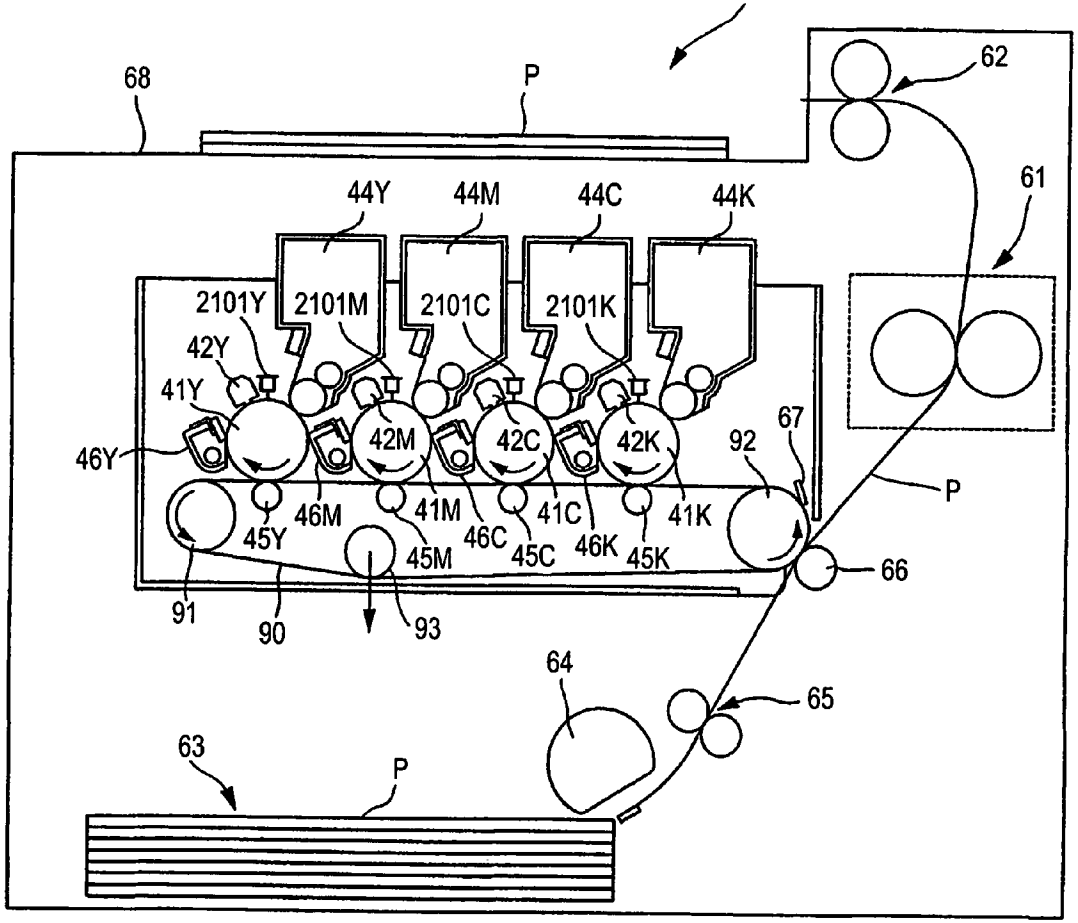
FIG. 16 schematically illustrates an image forming apparatus according to a fifth embodiment of the invention.

FIG. 16 illustrates an image forming apparatus according to a fifth embodiment of the invention. In FIG. 16, reference numeral 2080 is a tandem type image forming apparatus. The image forming apparatus 2080 has the same configuration as that of the image forming apparatus illustrated in FIG. 7, except that the exposure apparatus is configured by arranging the organic EL array line heads 2101K, 2101C, 2101M, and 2101Y of the above-referenced embodiment to four photosensitive drums 41K, 41C, 41M, and 41Y, respectively. Accordingly, the same elements are denoted by the same reference numerals and their description will be omitted.

Four-Cycle Type Image Forming Apparatus

Figure 17:
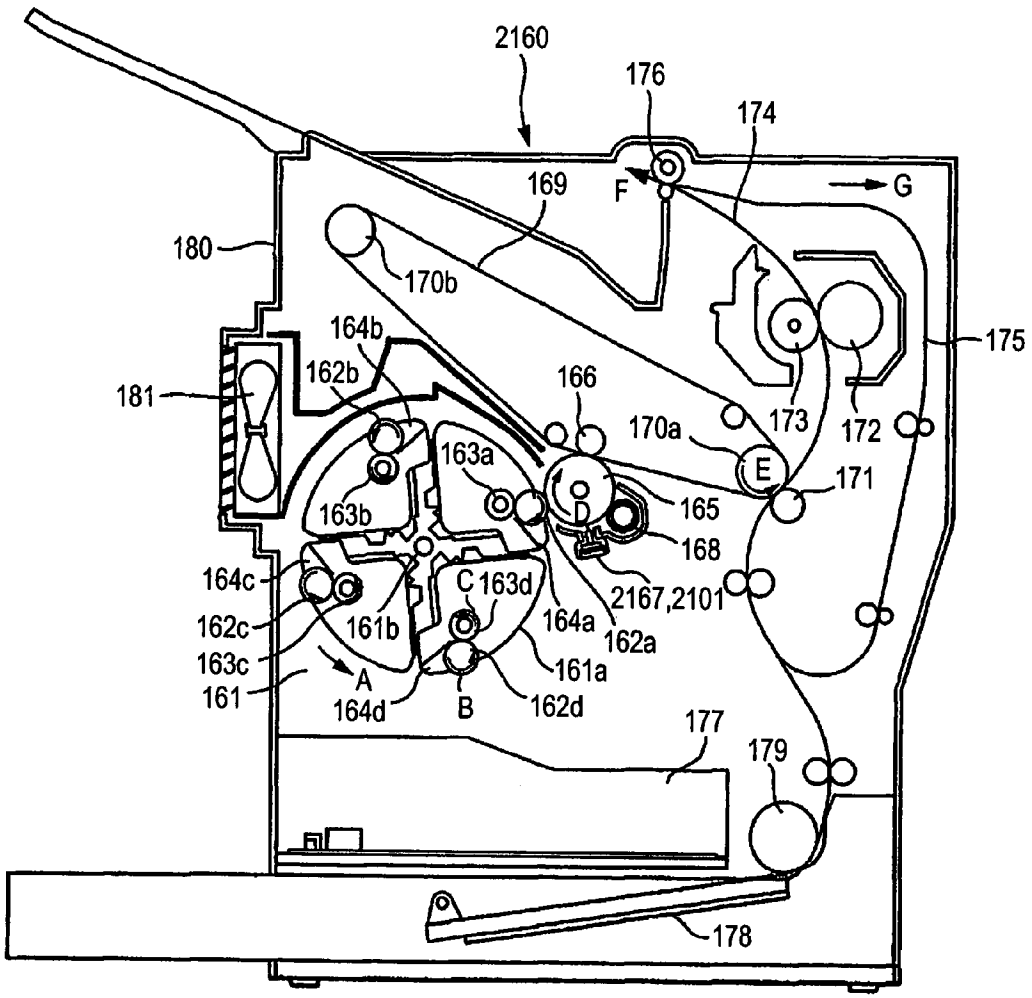
FIG. 17 schematically illustrates an image forming apparatus according to a sixth embodiment of the invention.

Next, an image forming apparatus of a sixth embodiment of the invention will be described. FIG. 17 is a longitudinal cross-sectional view of a four-cycle type image forming apparatus 2160. The image forming apparatus 2160 has the same configuration as that of the image forming apparatus illustrated in FIG. 8, except that the line head module 2101 according to the above-referenced embodiment is used in an image writing unit 2167. Accordingly, the same elements are denoted by the same reference numerals and their description will be omitted.

In the image forming apparatuses 2080 and 2160 illustrated in FIGS. 16 and 17, the exposure apparatus of the invention illustrated in FIG. 1 is included as an exposure unit.

Accordingly, in the image forming apparatuses 2080 and 2160, as described above, by switching the line heads, it is possible to ensure sufficient life span and perform high-speed printing.

Exposure Apparatus

An exposure apparatus of another embodiment of the invention will be described. The basic configuration of the exposure apparatus is the same as that of the exposure apparatus illustrated in FIG. 1 and thus its description will be omitted.

Line Head Module

Figure 18A:
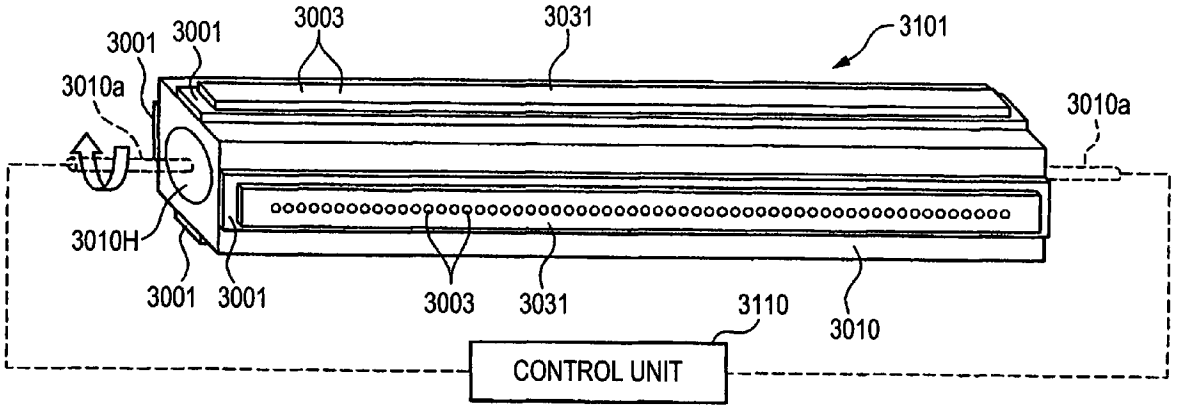
FIG. 18A is a perspective view of a line head module according to another embodiment.
Figure 18B:
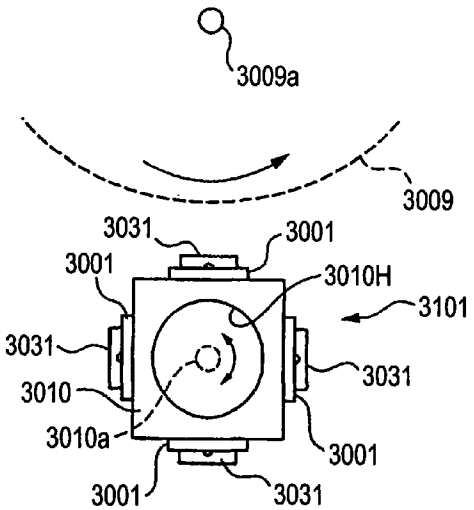
FIG. 18B is a cross-sectional view thereof.

FIGS. 18A and 18B schematically illustrate a configuration of a line head module 3101, where FIG. 18A is a perspective view thereof and FIG. 18B is a cross-sectional view thereof.

AS illustrated in FIGS. 18A and 18B, the line head module 3101 includes line heads 3001 on which a plurality of light emission elements 3 are arrayed, lens arrays 3031 on which lens elements for imaging the light from the line head 3001 are arrayed, and a support 3010 for supporting the line heads 3001.

In FIGS. 18A and 18B, the support 3010 is formed in a square column shape. A rotation axis 3010*a* parallel to a rotation axis 3009*a* of a photosensitive drum 3009 is provided at the center of the support 3010. The rotation axis 3010*a* is connected to a control unit 3110 and the rotation of the support 3010 is controlled by a control signal from the control unit 3110. Line heads 3001 are provided on a plurality of peripheral surfaces which are arranged in the peripheral direction of the support 3010, that is, the four side surfaces of the square column. The line heads 3001 are switched by rotating the support 3010 about the rotation axis 3010*a*. In addition, the driving of the plurality of line heads 3001 is switched by switching the line heads 3001. That is, while any one line head 3001 is selected, the other line heads 3001 are not driven.

The line heads 3001 are switched depending on the reduction in the light amount of the light emission element 3003 included in the line head 3001. In a case where the light amount of the light emission element 3003 is insufficient upon the exposure of the photosensitive drum 3009, in a case where the life span of the light emission element is completed, the control unit 3110 rotates the support 3010 by 90° about the rotation axis 3010*a* such that another line head 3001 can be used. The reduction in the light amount may be directly detected using a sensor or determined based on a print condition (the light amount, a print speed, or the like) or the print number. It is preferable that the line heads 3001 is automatically switched depending on the reduction in the light amount. For example, in a case where one line head 3001 can print two hundred thousand sheets at a speed of 20 ppm, the control unit 3110 may be programmed such that, when the print number becomes two hundred thousands, the support 3010 automatically rotates about the rotation axis 3010*a* by 90° and thus another line head 3001 can be used. By this configuration, the image forming apparatus can print eight hundred thousand sheets.

A perforated hole 3010H is perforated in the center of the support 3010 from one end to the other end of the longitudinal direction of the support 3010. The perforated hole 3010H forms a flow channel for allowing a cooling medium to flow in the support 3010. The flow channel 3010H is thermally connected to the line head 3001 through the support 3010. The cooling medium circulates through the flow channel 3010H such that the line head 3001 is cooled. The flow channel 3010H is provided in parallel with the rotation axis 3010*a*. One opening (left opening) formed in one end of the support 3010 is an inlet and the other opening (right opening) formed in the other end thereof is an outlet. In addition, in the present embodiment, although the flow channel 3010H has a straight line shape, the shape of the flow channel is not limited to this. Moreover, although the inlet and the outlet of the flow channel 3010H are provided in the ends of the support 3010, they may be provided in the peripheral surface (a portion on which the line head 3001 is not provided) of the support 3010.

Figure 19:
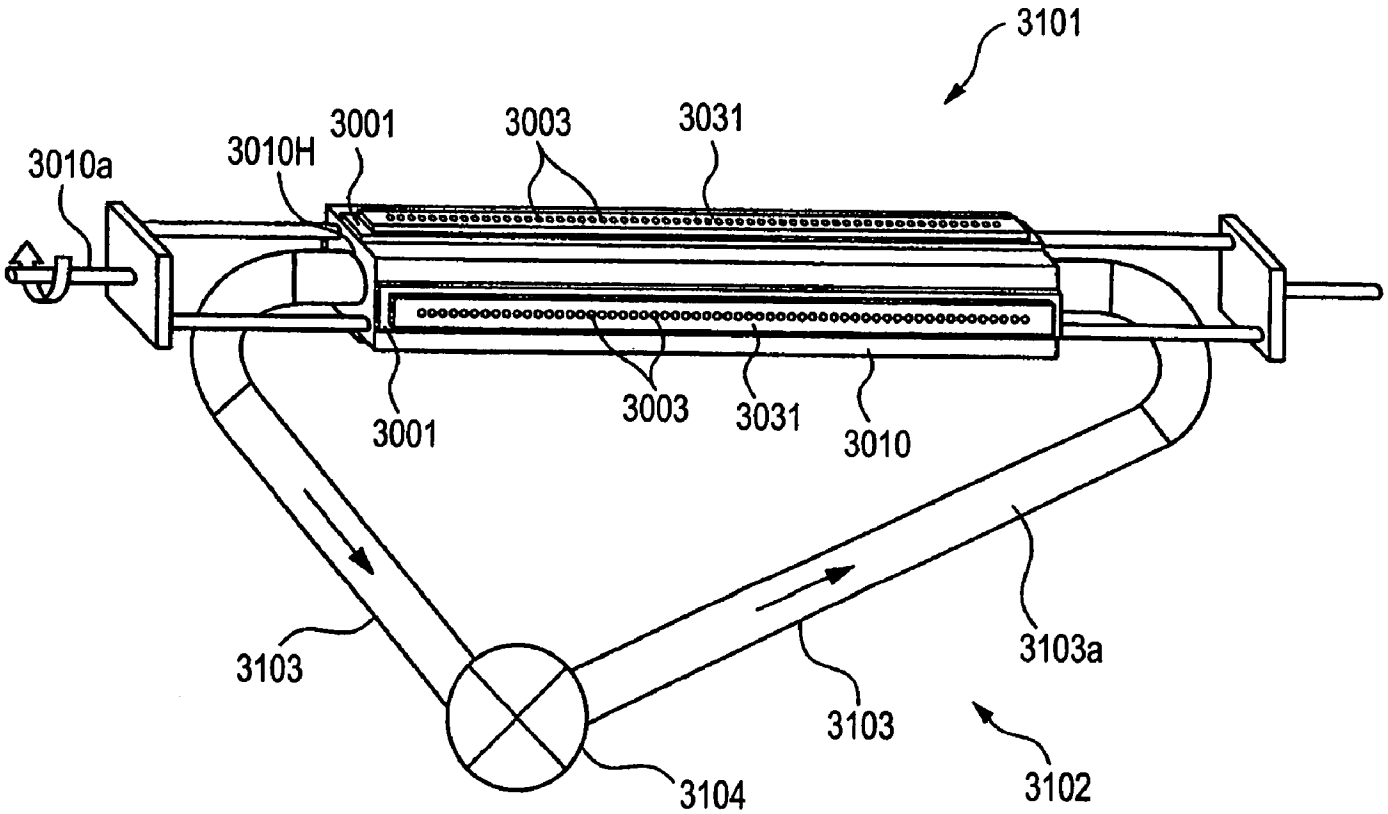
FIG. 19 is a view illustrating a cooling mechanism of the line head module.

FIG. 19 illustrates a cooling mechanism of the line head module 3101.

The cooling mechanism 3102 of the present embodiment includes a flow channel 3010H provided in the support 3010, tubes 3103 for allowing a cooling medium 3103*a* to circulate into or out of the flow channel 3010H, and a pump 3104 connected to the tube 3103. The tubes 3103 are mounted at the inlet and the outlet of the flow channel 3010H and the other ends of the tubes 3103 are connected to each other through the pump 3104. The cooling medium 3103*a* is filled in the tubes 3103 and the flow channel 3010H and circulates by the pump 3104. Furthermore, although not illustrated, a heat dissipating unit for dissipating heat absorbed in the cooling medium 3103*a* is provided in the circulating path.

In the present embodiment, since the support 3010 rotates such that the line head 3001 are switched, it is preferable that the tubes 3103 have flexibility such that the tubes 3103 can be deformed when the support 3010 rotates. The tube may be preferably made of resin having high flexibility and a relatively high strength, such as Teflon (registered trademark).

Furthermore, since the support 3010 functions as a heat transmission medium for thermally connecting the flow channel 3010H with the line head 3001, the support 3010 is preferably made of metal having high heat transmission, such as SUS, aluminum, brass, or the like.

As the cooling medium, the known cooling medium disclosed in JP-A-5-121609 or JP-A-5-326778 may be used.

The operation of the cooling mechanism 3102 is controlled depending on the state of driving the line head 3001. For example, the circulation of the cooling medium 3103*a* is turned on/off in synchronization with the driving/stop of the line head 3001 or the on/off of the main body of the printer. Alternatively, the circulation speed may be controlled depending on the overheat state of the line head 3001 (the temperature, the light emission time, and the light emission brightness of the light emission element 3, and the temperature of the inside of the exposure apparatus 3100). In the latter method, there is a method of monitoring the temperature of the line head 3001, for example, by a thermocouple and automatically controlling the circulation speed of the cooling medium 3103*a* such that the temperature does not become 50° C. or more. As such, by controlling the circulation of the cooling medium 3103*a* depending on the state of driving the line head 3001, the output of the line head 3001 becomes stable and thus good printing quality can be obtained.

In addition, in FIGS. 18A and 18B, although the line heads 3001 are provided on all the side surfaces of the support 3010, the line heads 3001 need not be necessarily provided on all the side surfaces. That is, the line heads 3001 may be provided on only two or three of the four side surfaces. Furthermore, as the support 3010, a polygonal column such as a triangular column, a pentagonal column, or a hexagonal column may be used. The line heads 3001 may be provided on at least two side surfaces of the polygonal column. Moreover, as the support 3010, a column having curved surfaces at a portion thereof, such as a circular column or an elliptical column, can be used. In the column such as the circular column or the polygonal column, in order to standardize the lens arrays 3031, it is preferable that the cross-sectional shape of the column has a regular polygonal shape or circular shape.

Furthermore, in the present embodiment, the plurality of line heads 3001 provided on the same support 3010 can be mutually used as spares. Accordingly, it is preferable that the line heads 3001 have the same specification. Alternatively, the line heads 3001 may have different specifications such that the line heads 3001 can complement with one another.

As the lens arrays 3031 of the present embodiment, the SL arrays are used, similar to the lens array 31 of the first embodiment, and thus its description will be omitted.

Line Head

The basic configuration of the line head 3001 according to the present embodiment is the same as that of the line head 1 illustrated in FIG. 4 and thus its description will be omitted.

Organic EL Element and Driving Element

The detailed configuration of organic EL element or the driving element in the line head 3001 according to the present embodiment is the same as that of the organic EL element or the driving element illustrated in FIGS. 6A and 6B and thus its description will be omitted.

As described above, in the present embodiment, the flow channel 3010H for cooling, which is thermally connected with the line head 3001, is provided in the support 3010 for supporting the line head 3001. The cooling medium 3103*a* circulates through the flow channel 3010H such that the line head 3001 is cooled. Accordingly, it is possible to improve the durability of the line head 3001 and thus to extend the life span of the exposure apparatus. Furthermore, in the present embodiment, the plurality of line heads 3001 (that is, light emission element row 3003A is assigned to one photosensitive drum 3009. Accordingly, it is possible to increase the life span of the line head and perform printing with a high speed and a great amount of the light. Moreover, since the line heads 3001 are switched by rotating the support 3010, the size of the line head module 3101 is reduced and thus the exposure apparatus 3100 and the image forming apparatus including the exposure apparatus 3100 as an exposure unit can be minimized.

In addition, in the present embodiment, although the plurality of line heads 3001 are provided on the support 3010 and are switched by rotating the support 3010, the invention is not limited to this configuration. For example, only one line head 3001 may be provided on the support 3010 and the support 3010 may not rotate. In this case, since the tubes 3103 are not deformed, the material of the tube need not have flexibility.

Next, an image forming apparatus including the exposure apparatus according to the above-referenced embodiment as an exposure unit will be described.

Tandem Type Image Forming Apparatus

Figure 20:
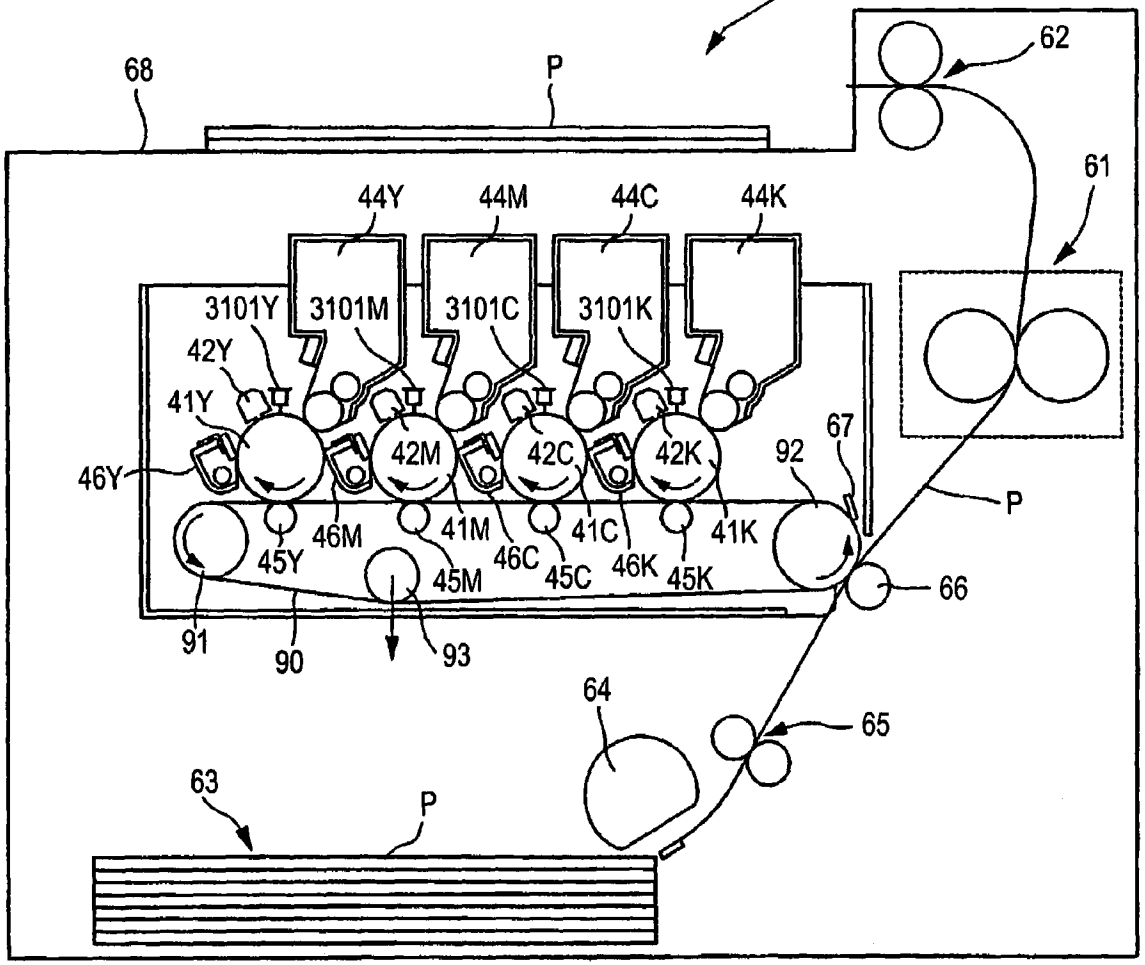
FIG. 20 schematically illustrates an image forming apparatus according to a seventh embodiment of the invention.

FIG. 20 illustrates an image forming apparatus according to a seventh embodiment of the invention. In FIG. 20, reference numeral 3080 is a tandem type image forming apparatus. The image forming apparatus 3080 has the same configuration as that of the image forming apparatus illustrated in FIG. 7, except that the exposure apparatus is configured by arranging the organic EL array line heads 3101K, 3101C, 3101M, and 3101Y of the above-referenced embodiment to four photosensitive drums 41K, 41C, 41M, and 41Y, respectively. Accordingly, the same elements are denoted by the same reference numerals and their description will be omitted.

Four-Cycle Type Image Forming Apparatus

Figure 21:
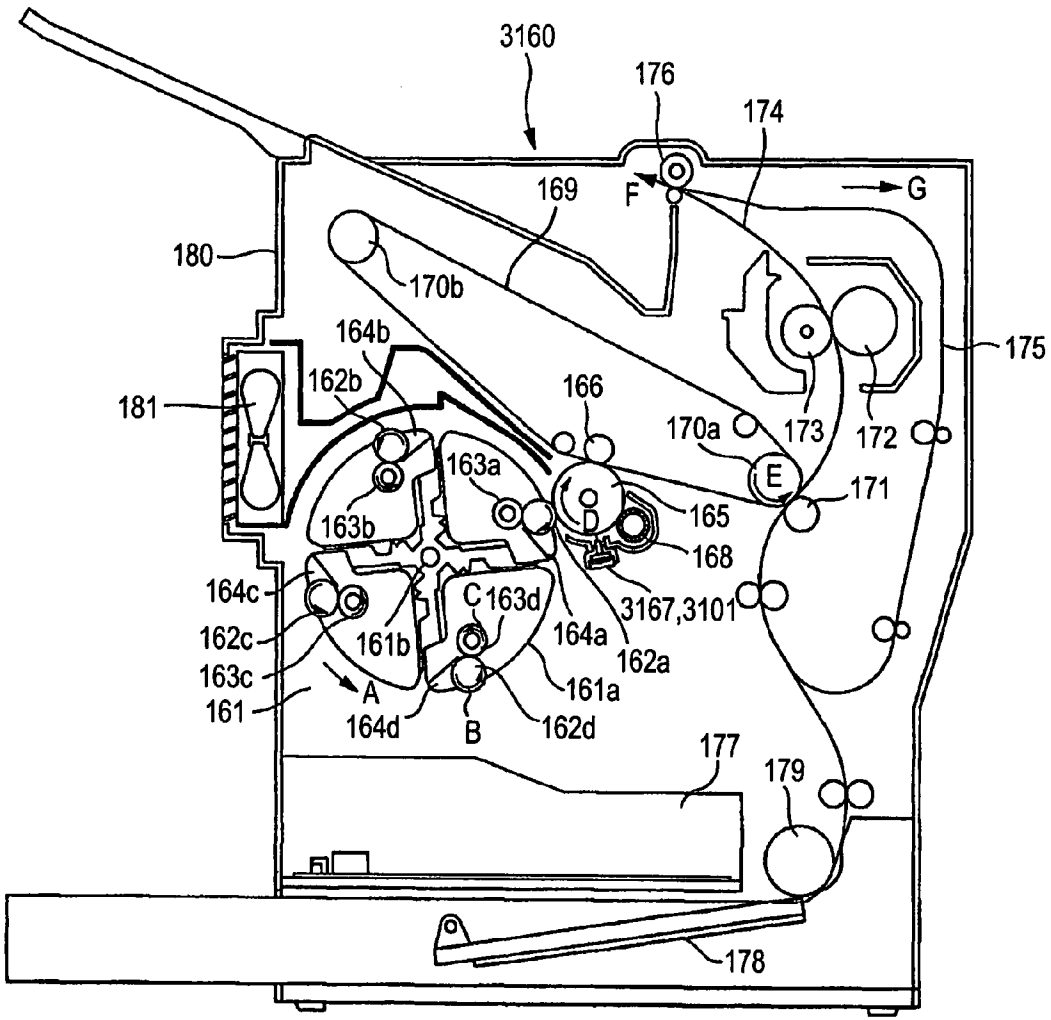
FIG. 21 schematically illustrates an image forming apparatus according to an eighth embodiment of the invention.

Next, an image forming apparatus of an eighth embodiment of the invention will be described. FIG. 21 is a longitudinal cross-sectional view of a four-cycle type image forming apparatus 3160. The image forming apparatus 3160 has the same configuration as that of the image forming apparatus illustrated in FIG. 8, except that the line head module 3101 according to the above-referenced embodiment is used in an image writing unit 3167. Accordingly, the same elements are denoted by the same reference numerals and their description will be omitted.

In the image forming apparatuses 3080 and 3160 illustrated in FIGS. 20 and 21, the exposure apparatus of the invention illustrated in FIG. 1 is included as an exposure unit.

Accordingly, in the image forming apparatuses 3080 and 3160, as described above, by switching the line heads, it is possible to ensure sufficient life span and perform high-speed printing.

Moreover, the image forming apparatus including the exposure apparatus according to the invention is not limited to the above-referenced embodiments and may be variously modified. Furthermore, the line head module according to the invention widely applies to various image forming apparatuses such as a printer, a copier, or the like.

Although the embodiments of the invention are described with reference to the attached drawings, the invention is not limited to these embodiments. In the above-referenced embodiments, various shapes of the elements or combinations thereof are merely examples and may be variously changed based on the required design, without departing from the spirit and scope of the present invention.

Although the present invention has been shown and described with reference to specific preferred embodiments, addition, omission, substitution, and modifications will be apparent to those skilled in the art from the teachings herein. The scope of the invention is defined not by the detailed description of the invention but by the appended claims.

What is claimed is:

1. A line head module for exposing a photosensitive body, comprising:

a support having a first circumferential surface and a second circumferential surface facing in different directions, the support having a rotation axis parallel to the photosensitive body, the rotation axis rotating to switch positions of the first circumferential surface and the second circumferential surface; and a first line head and a second line head for exposing the photosensitive body, the first line head and the second line head being provided on the first circumferential surface and the second circumferential surface, respectively, and being switched with respect to the photosensitive body when positions of the first circumferential surface and the second circumferential surface are switched by rotation of the rotation axis.

2. The line head module according to claim 1, wherein the first and second line heads are switched depending on a reduction in a light amount of light emission elements of the first and second line heads.

3. The line head module according to claim 1, wherein the first and second line heads are line heads having different specifications from each other and are switched depending on a use thereof.

4. The line head module according to claim 3, further comprising a third line head having the same specification as the second line head, the specification of the second and third line heads being more frequently used than the specification of the first line head, the second and third line heads being switched depending on a reduction in a light amount of light emission elements of the second and third line heads.

5. The line head module according to claim 1, wherein EL elements are formed on surfaces of the first and second line heads, the surfaces being supported by the support, and the EL elements being sealed by the support.

6. The line head module according to claim 5, wherein concave portions are provided in side surfaces of the support and the EL elements are hermetically sealed in the concave portions between the support and the first and second line heads.

7. The line head module according to claim 5, further comprising an adhesive layer which adheres the line heads to the support, wherein the EL elements are covered by the adhesive layer and the support.

8. An exposure apparatus comprising:

the line head module according to claim 1; and the photosensitive body which is exposed by light from EL elements included in the line head module.

9. An image forming apparatus comprising the exposure apparatus according to claim 8 as an exposure unit.

10. The line head module according to claim 1, wherein the support is formed in a column shape or a plate shape.

11. The line head module according to claim 1, wherein an optical imaging system which images light from light emission elements is provided in each of the first and second line heads.

12. The line head module according to claim 1, wherein light emission elements of the first and second line heads are electroluminescence elements.

13. The line head module according to claim 12, wherein the light emission elements are organic electroluminescence elements.

14. A line head module for exposing a photosensitive body, comprising:

a first line head and a second line head for exposing the photosensitive body;

a support which supports the first and second line heads, the support having a rotation axis parallel to the photosensitive body and the rotation axis going through a center of the support;

a flow channel that follows the rotation axis of the support and that is thermally connected to the line heads through the support; and a cooling medium which circulates through the flow channel to cool the support.

15. The line head module according to claim 14, wherein the support is made of metal.

16. The line head module according to claim 14, wherein the circulation of the cooling medium is controlled depending on a state of driving the first and second line heads.

17. The line head module according to claim 14, wherein the rotation axis extends parallel to the photosensitive body, and the first and second line heads are provided on circumferential surfaces of the support and switched with respect to the photosensitive body by rotating the support about the rotation axis.

18. The line head module according to claim 14, further comprising a tube which allows the cooling medium to circulate into or out of the flow channel.

19. An exposure apparatus comprising:

the line head module according to claim 14; and the photosensitive body which is exposed by light from light emission elements included in the line head module.

20. An image forming apparatus comprising the exposure apparatus according to claim 19 as an exposure unit.

* * * * *